US006509810B2

(12) United States Patent
Ota et al.

(10) Patent No.: US 6,509,810 B2
(45) Date of Patent: Jan. 21, 2003

(54) FILTER, DUPLEXER, AND COMMUNICATION DEVICE

(75) Inventors: Michiaki Ota, Kyoto (JP); Seiji Hidaka, Nagaokakyo (JP); Yasuo Fujii, Nagaokakyo (JP); Shin Abe, Mukuo (JP)

(73) Assignee: Murata Manufacturing Co. Ltd.

( * ) Notice: Subject to any disclaimer, the term of this patent is extended or adjusted under 35 U.S.C. 154(b) by 11 days.

(21) Appl. No.: 09/891,625

(22) Filed: Jun. 26, 2001

(65) Prior Publication Data

US 2002/0039055 A1 Apr. 4, 2002

(30) Foreign Application Priority Data

Jun. 26, 2000 (JP) ..... 2000-191639

(51) Int. Cl.[7] ..... H01P 1/213; H01P 1/203
(52) U.S. Cl. ..... 333/134; 333/204; 333/219
(58) Field of Search ..... 333/134, 204, 333/219, 185; 505/210

(56) References Cited

U.S. PATENT DOCUMENTS 4,757,285 A * 7/1988 Krause ..... 333/203
4,981,838 A * 1/1991 Whitehead ..... 505/210
6,026,311 A * 2/2000 Cortes et al. ..... 505/210
6,108,569 A * 8/2000 Shen ..... 505/210
6,370,404 B1 * 4/2002 Shen ..... 505/210
6,411,181 B1 * 6/2002 Ishikawa et al. ..... 333/219

FOREIGN PATENT DOCUMENTS

EP 1014469 A2 6/2000
JP 02096402 4/1990

* cited by examiner

*Primary Examiner*—Robert Pascal
*Assistant Examiner*—Dean Takaoka
(74) *Attorney, Agent, or Firm*—Dickstein, Shapiro, Morin & Oshinsky, LLP.

(57) ABSTRACT

A filter and a duplexer in which power loss due to the edge effect in resonator lines, is very effectively suppressed, which allow more reduction in overall size to be achieved, and which have desired filter characteristics, and a communication device including either or both of the filter and the duplexer. Three multiple spiral resonator stages are constructed by disposing three multiple spiral lines on the top surface of a dielectric substrate, and forming a ground electrode on the bottom surface thereof. If the first stage is set to be a right-handed spiral resonator, and the second and third stages are set to be left-handed spiral resonators, an attenuation pole is thereby created on the higher frequency side of a pass band.

11 Claims, 22 Drawing Sheets

FIG. 3
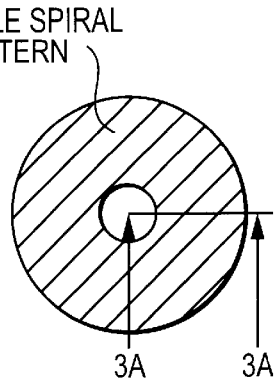
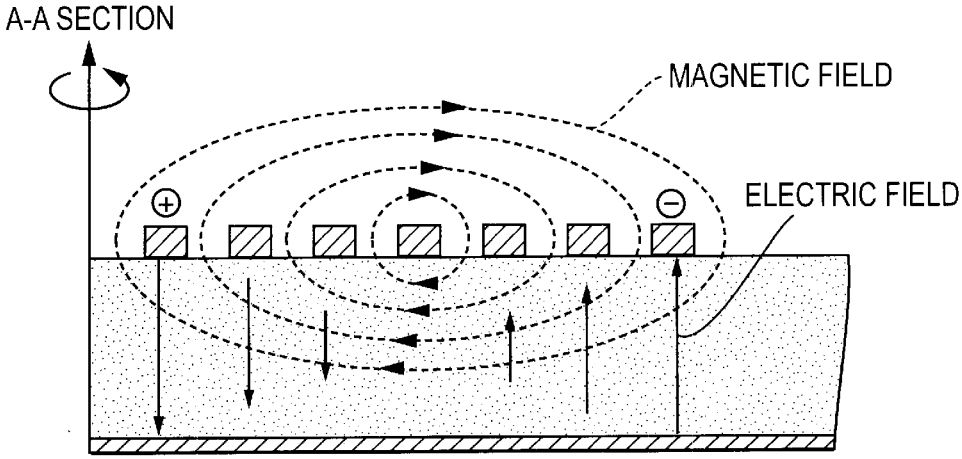
FIG. 3A
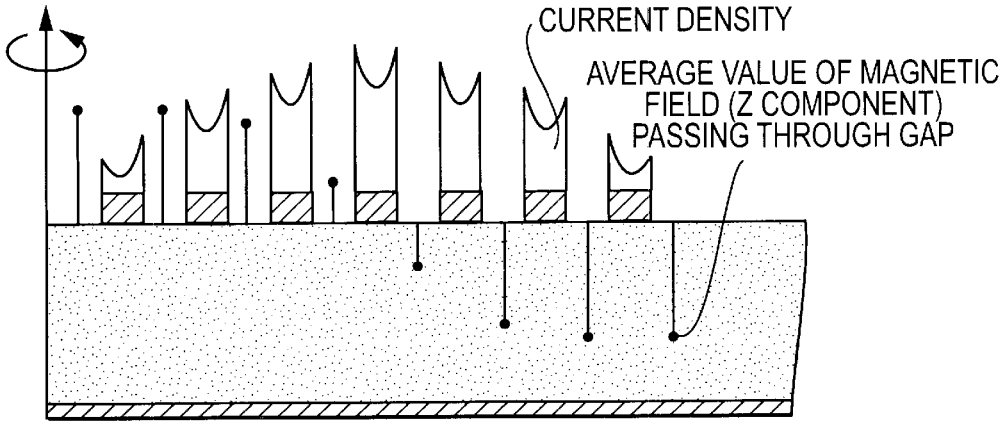
FIG. 3B

FIG. 4
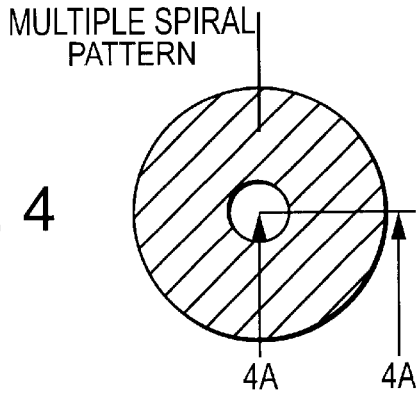
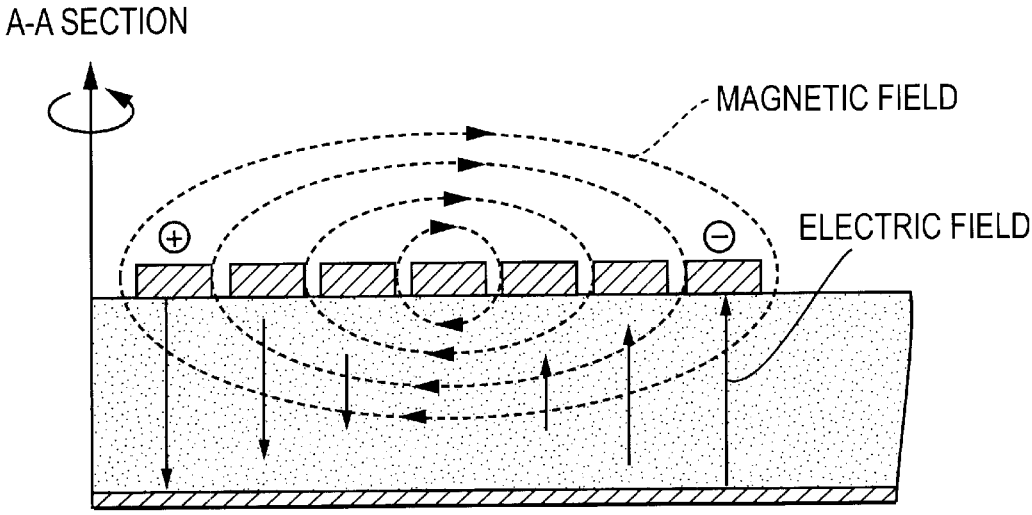
FIG. 4A
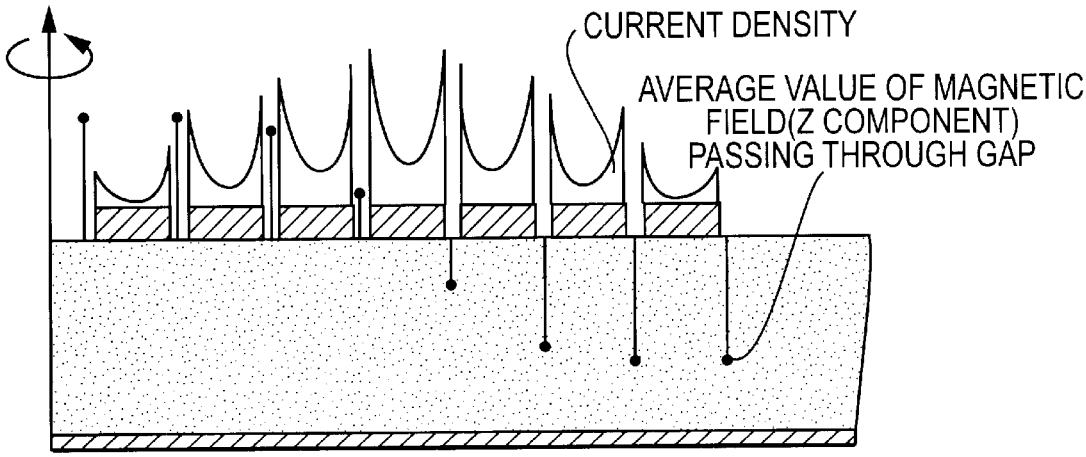
FIG. 4B $$\omega_0 = \frac{1}{\sqrt{LC}} \quad (1)$$

$$B_0 = \sqrt{\frac{C}{L}} \quad (2)$$

$$Q_0 = \frac{1}{G}\sqrt{\frac{C}{L}} = \frac{B_0}{G} \quad (3)$$

$$Z_1 = \sqrt{\frac{Z_0}{B_1}}, \quad (4)$$

$$Z_2 = \sqrt{\frac{Z_0}{B_2}}, \quad B_2 = B_0 \quad (5)$$

$$J = \omega C_m \quad (6)$$

$$K = \omega M \quad (7)$$

$$k_C = \frac{\omega C_m}{\sqrt{B_{01} B_{02}}} \quad (8)$$

$$k_L = \frac{\omega M}{\sqrt{X_{01} X_{02}}} \quad (9)$$

$$k = k_C + k_L \quad (10)$$

$$C^{(eff)} = \frac{k}{\omega\sqrt{B_{01},B_{02}}} = \frac{k_C + k_L}{\omega\sqrt{B_{01},B_{02}}} = C_m + \frac{M}{\sqrt{B_{01}B_{02}X_{01}X_{02}}} \quad (11)$$

FILTER, DUPLEXER, AND COMMUNICATION DEVICE

BACKGROUND OF THE INVENTION

1. Field of the Invention

The present invention relates to a filter, a duplexer, and a communication device for use in radio communication or the transmission/reception of electromagnetic waves, in e.g. a microwave band or a millimeter wave band.

2. Description of the Related Art

As an example of a miniaturizable resonator which is used in a microwave band or millimeter wave band, a spiral resonator is disclosed in Japanese Unexamined Patent Application Publication No. 2-96402. This spiral resonator provides a longer resonance line in a given occupied area by forming the resonance line into a spiral shape, thereby achieving an overall size-reduction.

In a conventional resonator, one half wavelength line constitutes one resonator. Therefore, in a conventional resonator, the region where electrical energy is concentrated and stored, and the region where magnetic energy is concentrated and stored are separated from each other and unevenly distributed at specific areas of a dielectric substrate. More specifically, the electrical energy is stored in the vicinity of an open end of the half wavelength line, while the magnetic energy is stored in the vicinity of the center portion of the half wavelength line.

The resonator constituted of one microstrip line has a drawback, in that its characteristics are inevitably deteriorated by the edge effect which the microstrip line intrinsically possesses. Specifically, when viewing the line in cross-section, current is concentrated in the edge portions of the line (both ends in the width direction, and the upper and lower ends in the thickness direction of the line). Even if the film-thickness of the line is increased, the problem of the power loss due to the edge effect inescapably occurs, since the edge portions at which the current is concentrated can not be widened by an increase in the film-thickness.

Accordingly, the present applicants have applied for European Patent Application Publication No. EP 1 014 469 A2, which discloses a device which is capable of very effectively suppressing the power loss due the edge effect in the lines, and is also capable of achieving an overall size-reduction of the device.

SUMMARY OF THE INVENTION

In response to the above requirements, the present invention provides a filter and a duplexer which are capable of very effectively suppressing the power loss due to the edge effect in the lines, which allow a greater reduction in their overall size, and which provide desired filter characteristics, and further to provide a communication device including the filter and/or the duplexer.

The present invention, in a first aspect, provides a filter comprising at least three resonators arranged on a substrate, each of which resonators is an aggregate of a plurality of lines each having a spiral shape, in each of which the two ends of at least a portion of the plurality of lines are disposed respectively at substantially the inner and outer periphery portions of the aggregate and are arranged, preferably symmetrically, around a predetermined point of the substrate, and in each of which the plurality of lines are disposed so as not to intersect each other. In this filter, the spiral direction of the spiral lines in at least one resonator is set to be opposite to that of the spiral lines in the other resonators. These features allow an attenuation pole to be arbitrarily formed on the higher frequency side or the lower frequency side of a pass band when using this filter as a band pass filter.

The present invention, in a second aspect, provides a filter comprising at least three resonators arranged on a substrate, in each of which resonators the two ends of a plurality of lines are disposed respectively at substantially the inner and outer periphery portions, arranged preferably symmetrically around a predetermined point of a substrate, and in each of which the plurality of lines are disposed so as not to intersect each other. This filter further comprises input/output portions, and a coupling conductor provided at the inner periphery portion of at least one resonator. The inner periphery portion and the input/output portions are capacitively coupled by the coupling conductor. As in the case of the first aspect, these features allow an attenuation pole to be arbitrarily formed on the higher frequency side or the lower frequency side of a pass band.

The present invention, in a third aspect, provides a duplexer including a filter in accordance with the first or second aspect, usable as a transmitting filter or a receiving filter, or including filters in accordance with the first or second aspect, usable as a transmitting filter and a receiving filter. This makes it possible to provide a predetermined pass band, to reduce the insertion loss, to achieve an overall size-reduction of the filter, and to reliably prevent interference at an adjacent regions between a transmission band and a reception band.

The present invention, in a fourth aspect, provides a duplexer wherein the spiral direction of the spiral lines in the resonators constituting a transmitting filter and the spiral direction of the spiral lines in the resonators constituting a receiving filter are set to be opposite to each other. This feature allows the isolation between the transmitting filter and the receiving filter to be improved.

In a duplexer in accordance with the present invention, a filter which is constructed by arranging, on a substrate, at least three resonators, in each of which a plurality of spiral lines is distributed, and by capacitively coupling an inner periphery portion, defined by a plurality of lines of at least one resonator, to input/output portions of the filter, is preferably used as one of the transmitting filter and the receiving filter. On the other hand, the filter constructed by arranging at least three resonators in which a plurality of spiral lines having mutually identical spiral directions are distributed, is preferably used as the other filter.

By virtue of the described features, the present invention provides a duplexer which combines a filter having an attenuation pole on the lower frequency side of a pass band, and one having an attenuation pole on the higher frequency side of the pass band.

The present invention, in a fifth aspect, provides a communication device using the above-described filter or duplexer. This makes it possible to achieve an overall size-reduction thereof, to reduce the insertion loss at high-frequency transmission/reception portions, to reliably prevent the interference between adjacent bands, and to improve communication qualities such as the noise characteristics and the transmission speed.

The above and other objects, features, and advantages of the present invention will be clear from the following detailed description of the preferred embodiments of the invention in conjunction with the accompanying drawings.

Other features and advantages of the present invention will become apparent from the following description of the invention which refers to the accompanying drawings.

BRIEF DESCRIPTION OF THE DRAWINGS

FIGS. 3, 3A and 3B are views showing an example of the distribution of an electromagnetic field in the resonator shown in FIGS. 1A to 1D;

FIGS. 4, 4A and 4B are views showing an example of the distribution of an electromagnetic field of another resonator;

DETAILED DESCRIPTION OF EMBODIMENTS OF THE INVENTION

First, the principle of the resonator in the present invention will be described with reference to FIGS. 1 to 4.

Figure 1A:
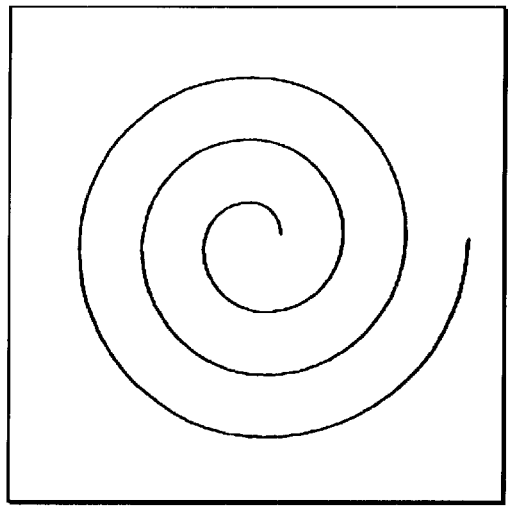
FIGS. 1A to 1D are views showing the configuration of a resonator formed of a multiple spiral line.
Figure 1B:
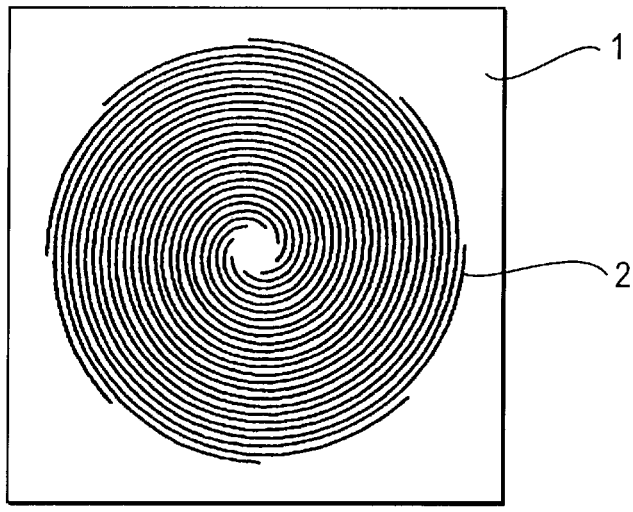
Figure 1C:
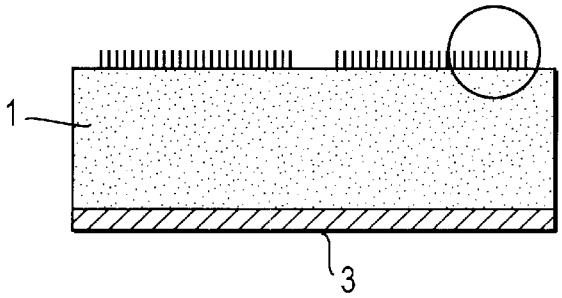
Figure 1D:
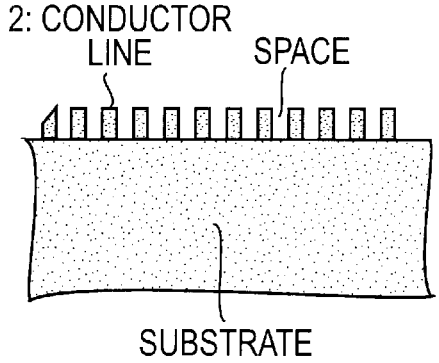

FIGS. 1B to 1D are views showing the configuration of a resonator, wherein FIG. 1B is a top view, FIG. 1C is a sectional view, and FIG. 1D is a partial enlarged to view. A ground electrode 3 is formed over the entire bottom surface of a dielectric substrate 1. Eight congruent spiral lines 2 each of which has open ends at both ends, are arranged on the top surface of the dielectric substrate so as not to intersect one another in a manner such that both ends of each of the lines are positioned symmetrically around a predetermined point (the center point) on the substrate. FIG. 1A representatively shows one line among the eight lines. The width of each of these lines is set to be substantially equal to the skin depth at a frequency to be used. Hereinafter, an aggregate of such spiral lines is referred to as a "multiple spiral line".

Figure 2A:
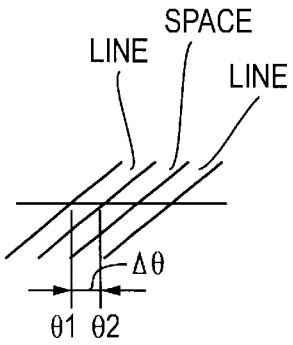
FIG. 2A is a view showing the multiple spiral line pattern of FIGS. 1A to 1D, the figure showing a conversion to Cartesian coordinates from polar coordinates.
Figure 2B:
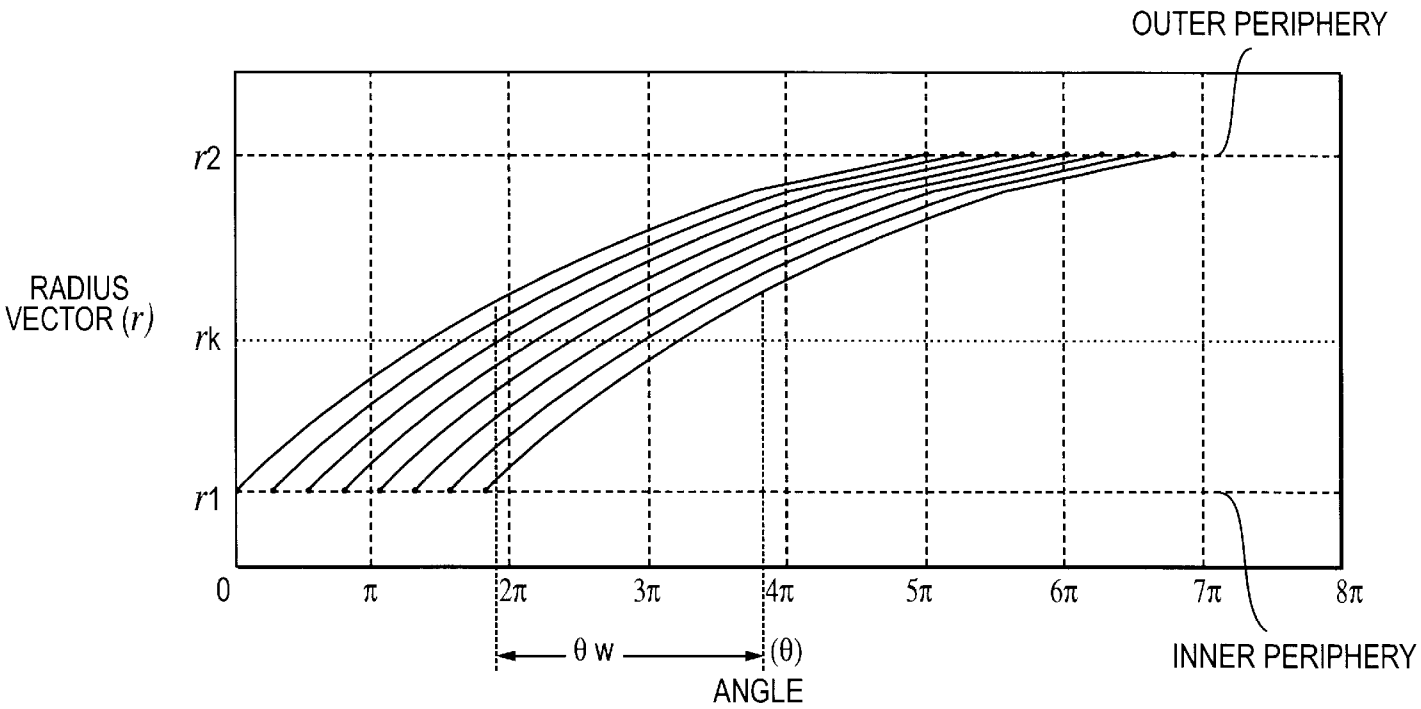
FIG. 2B is a view illustrating the derivation of angle widths from radius vectors.

FIG. 2B shows the shape of the eight lines shown in FIG. 1B, using parameters of polar coordinates. In this example, the radius vector r1 of the inner peripheral edge and radius vector r2 of the outer peripheral edge of each of the eight lines are constant, and the positions in the angle direction of each of the edges is uniformly spaced. Referring to FIG. 2A, when the angle at the left end at an arbitrary radius vector is $\theta 1$, and the angle at the right end is $\theta 2$, the angle width $\Delta\theta$ is expressed by $\Delta\theta=\theta 2-\theta 1$. Here, since the number of lines n=8, the angle width $\Delta\theta$ of one line is set to satisfy the relationship $\Delta\theta \leqq 2\pi/8(=\pi/4)$ radians. Also, the angle width $\theta w$ of the entire aggregate of the lines at an arbitrary radius vector rk is set to be within $2\pi$ radians.

These lines are coupled by mutual inductance and electrostatic capacitance. One resonator is formed by this multiple spiral line and the ground electrode 3 which are opposed to the multiple spiral line with the dielectric substrate 1 therebetween. Hereinafter, this resonator is referred to as a "multiple spiral resonator". Here, the radius vectors r1 and r2 are not necessarily required to be either constant, or arranged at equal angles. Furthermore, these lines are not necessarily required to be congruent. However, from the viewpoint of characteristics of the resonator and the ease of manufacturing thereof, it is desirable that r1 and r2 be constant, and that the resonator comprise congruent lines which are arranged at equal angles.

Figure 17A:
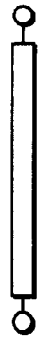
FIGS. 17A to 17C are equivalent circuit diagrams of spiral lines and multiple spiral resonators.
Figure 17B:
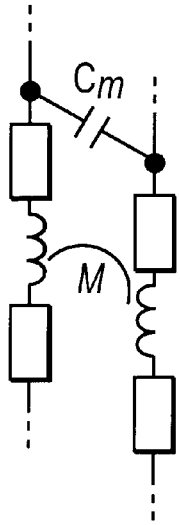
Figure 17C:
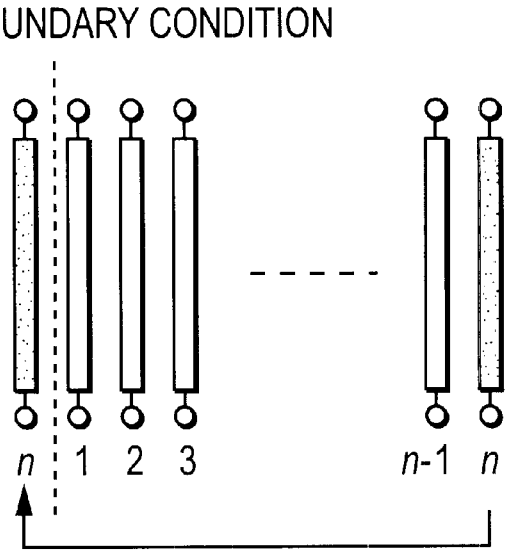

FIGS. 17A to 17C show equivalent circuits of individual spiral lines of the multiple spiral resonator. When viewing each individual spiral line, the multiple spiral resonator is expressed as a ½ wavelength resonator of which the inner and outer peripheral edges are each open, as shown in FIG. 17A. Also, as shown in FIG. 17B, each of the ½ wavelength resonators is coupled with the right and/or left adjacent resonator both capacitively and inductively. The coupling circuit of these two adjacent lines constitutes a distributed constant circuit as shown in FIG. 17B. The deviation of the coupling position shown in the figure implies that the positions exhibiting the shortest distance between a certain spiral line and the spiral line adjacent thereto have deviated. As shown in FIG. 17C, the equivalent circuit of the multiple spiral resonator can be expressed as an aggregate in which a plurality of ½ wavelength lines are coupled with one another. In a multiple spiral resonator having the number of lines of n, when the lines are each given numbers (1, 2, 3 . . . . . n−1, n), the n-th line and the 0-th line become equivalent due to a periodic boundary condition.

FIGS. 3, 3A and 3B show an example of the distribution of an electromagnetic field and a current in the multiple spiral line. FIG. 3 is a plan view showing a multiple spiral line, but the multiple spiral line is expressed by entirely shading the resonator without separating discrete lines. FIG. 3A shows the distribution of an electric field and a magnetic field along the section A—A of the multiple spiral line at the moment in which the charge at the inner peripheral edge and the outer peripheral edge of the lines is the largest. FIG. 3B shows the current density of each of the lines at the above-mentioned section and the average value of the z-component (in the direction perpendicular to the plane of the figure) of a magnetic field passing through each of the gaps between lines, at that moment.

When microscopically viewing each of the lines, the current density increases at the edges of each of the lines, as shown in the figures. However, when viewing a cross section in the radius vector direction, since conductor lines arranged on both sides of a given spiral line, with a specified spacing, have currents with substantially equal amplitude and phase as in the given spiral line, the edge effect is lessened. That is, when viewing the multiple spiral line as one line, the current density is distributed substantially sinusoidally in such a manner that the inner peripheral edge and the outer peripheral edge become nodes of current distribution, and the center portion becomes the antinode thereof, and hence macroscopically no edge effect occurs.

FIGS. 4, 4A and 4B show a comparative example wherein the line width shown in FIGS. 3–3B has been widened up to several times the skin depth. When the line width is thus widened, current concentrations due to the edge effect of conductor lines manifest themselves, as shown in the figures, thereby reducing the loss reduction effect.

Figure 18A:
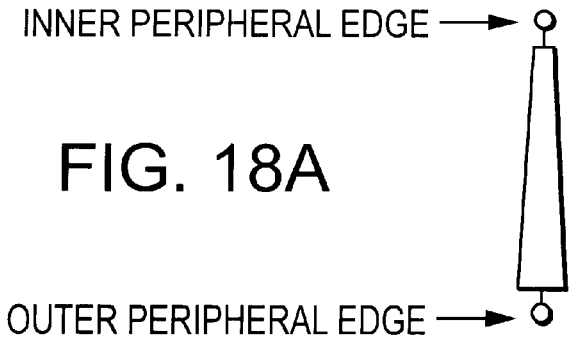
FIGS. 18A and 18B are each simplified equivalent circuit diagrams of a multiple spiral resonator.

In order to facilitate the theoretical treatment of the above-described multiple spiral resonator, FIG. 18A shows a simplified equivalent circuit thereof. This equivalent circuit constitutes a ½ wavelength line which has a corresponding open end at each of the inner and outer peripheral edges. The characteristic impedance of this line monotonically decreases from the inner peripheral edge to the outer peripheral edge. This is because, as the position on a line gets close to the outer peripheral portion, the potentials of adjacent lines become large, and thereby the capacitance of the line increases. This characteristic of the resonator implies that the susceptance slope of the resonator is larger when viewed at the outer periphery than when viewed at the inner periphery.

This means that, when attempting to obtain a given coupling coefficient (or external Q), a larger capacitance is required when capacitive coupling is performed at the outer periphery than when performed at the inner periphery.

Figure 18B:
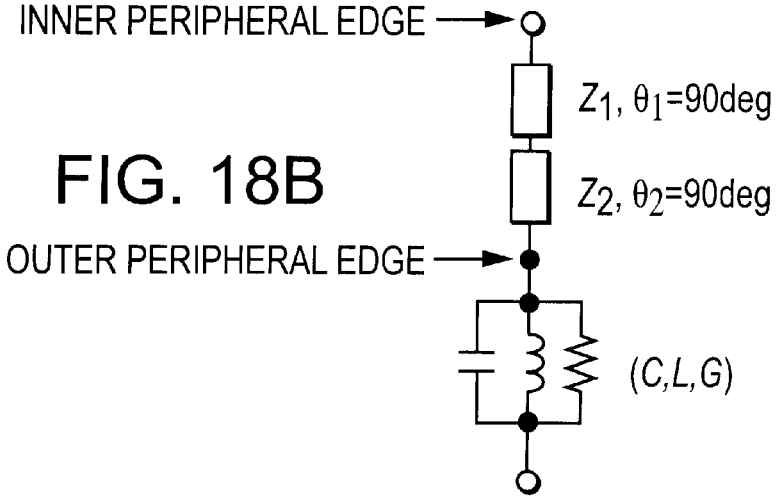

One possible circuit which can meet the above-described conditions at the inner and outer peripheries is a converted equivalent circuit as shown in FIG. 18B. This equivalent circuit is constructed by connecting two ideal 90° lines, which are independent of frequency, in series with a concentrated-constant type parallel resonance circuit constituted of C, L, and G. These two ideal 90° lines add up to a phase angle of 180°, and have functions of reversing the voltage sign between the inner and outer peripheries, and also of converting the susceptance slope. The resonance frequency $\omega_0$ of this parallel resonance circuit is given by the equation (1), the susceptance slope $B_0$ by the equation (2), and $Q_0$ by the equation (3).

When the susceptance slope $B_0$ of the parallel resonance circuit is matched with the susceptance slope $B_2$ when viewed at the outer periphery, the characteristic impedances Z1 and Z2 of the two 90° lines are given by the equations (4) and (5), respectively. Here, $Z_0$ is a reference inpedance, and is set to 50 Ω.

Figure 19A:
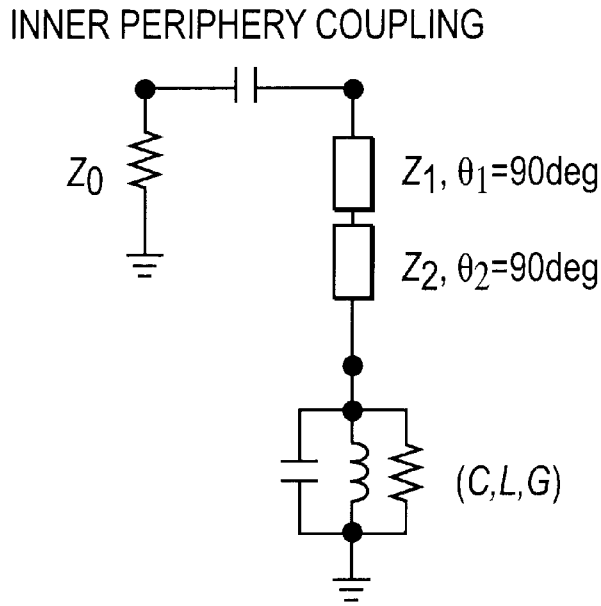
FIGS. 19A and 19B are each equivalent circuit diagrams of a multiple spiral resonator under external coupling conditions.
Figure 19B:
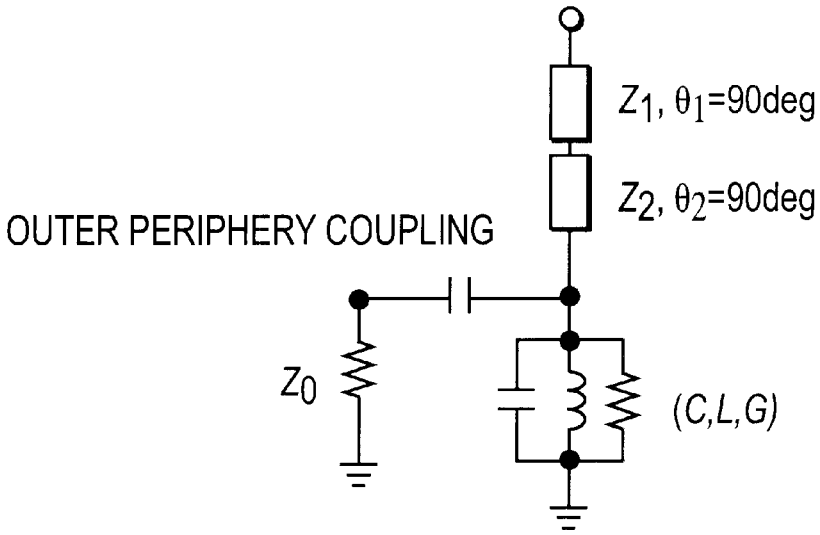

FIGS. 19A and 19B are equivalent circuits of an external coupling with respect to the multiple spiral resonator. As described later, the equivalent circuit when an external coupling is provided at the inner peripheral edge of the multiple spiral resonator, is expressed by an equivalent circuit as shown in FIG. 19A, a concentrated constant capacitive element is connected to the inner peripheral edge in the equivalent circuit shown in FIG. 18B. On the other hand, the equivalent circuit when an external coupling is provided at the outer peripheral edge of the multiple spiral resonator, is expressed by an equivalent circuit as shown in FIG. 19B. This indicates that the sign of the voltage which excites the resonator when the external coupling is provided at the outer peripheral edge is opposite that when the external coupling is provided at the inner peripheral edge.

When two multiple spiral resonators are disposed adjacent to each other, which is a possible form of interstage coupling, there are two types of coupling: electrical coupling and magnetic coupling. Herein, depending upon the polarity of a left-handed spiral and that of a right-handed spiral in these multiple spiral resonators, the sign of only the magnetic coupling coefficient is changed, so that the overall coupling coefficient is determined depending on whether the above-described two types of coupling cooperate with each other or cancel each other.

Figure 20:
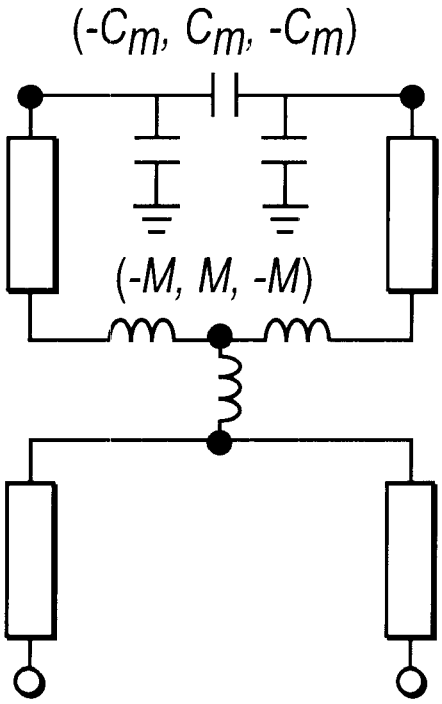
FIG. 20 is an equivalent circuit diagram of an interstage coupling between two half wavelength lines.

Such situations can be expressed by an equivalent circuit using both capacitive coupling and mutual inductive coupling as shown in FIG. 20. In FIG. 20, each of the resonators is expressed by a half wavelength line constituted of two 90° lines. The electrical coupling is expressed by a r-type capacitive coupling circuit at an open end (antinode of voltage amplitude) and the magnetic coupling is expressed by a T-type mutual inductive coupling circuit at a short-circuit end (antinode of current amplitude).

In these coupling circuits, a J inverter value and a K inverter value are given by equations (6) and (7), respectively. Letting the slope parameters when viewed at the open end and the short-circuited end of these resonators be ($B_{01}$, $X_{01}$), ($B_{02}$, $X_{02}$), the electrical coupling coefficient $k_C$ and the magnetic coupling coefficient $k_L$ are expressed by the equations (8) and (9), respectively, using the above-described values. An overall coupling coefficient k is expressed by the equation (10), as a sum including the signs of both coefficients.

Figure 21A:
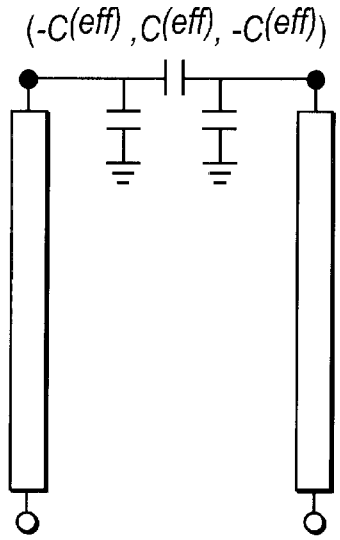
FIG. 21A is an equivalent circuit diagram expressed by a capacitive coupling between two half wavelength lines.

Since the overall coupling coefficient between the adjacent resonators can be thus expressed as the sum of an electrical coupling coefficient and a magnetic coupling coefficient, even an equivalent circuit can be expressed, in a unified way, by either a capacitive coupling or a mutual inductive coupling. FIG. 21A is an equivalent circuit expressed only by a capacitive coupling after converting the equivalent circuit shown in FIG. 20. The value of the capacitance value at this time is an effective value including a portion belonging to the magnetic coupling, and is given by the equation (11).

Figure 21B:
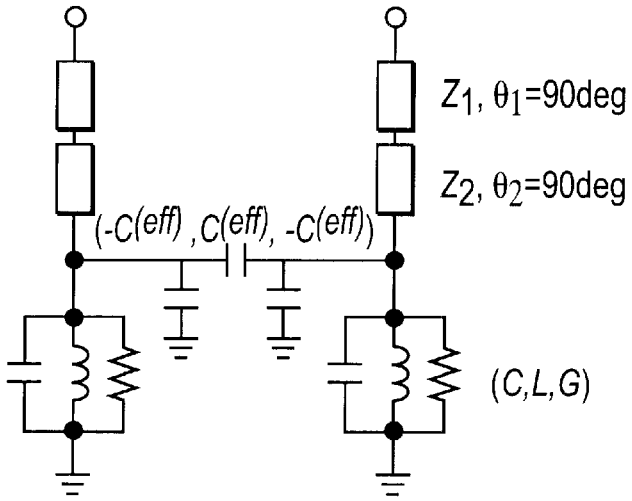
FIG. 21B is an equivalent circuit diagram when two multiple spiral resonators have been coupled.

Ultimately, the equivalent circuit of these coupled multiple spiral resonators can be expressed as shown in FIG. 21B. Table 1 below shows the method for selecting the sign of magnetic coupling coefficient depending upon the polarity, which sign is necessary to calculate an effective capacitance value.

TABLE 1

| POLARITY | | SIGN |
|---|---|---|
| LEFT-HANDED | LEFT-HANDED | $k_1 > 0$ |
| RIGHT-HANDED | RIGHT-HANDED | $k_1 > 0$ |
| LEFT-HANDED | RIGHT-HANDED | $k_1 < 0$ |
| RIGHT-HANDED | LEFT-HANDED | $k_1 < 0$ |

Figure 22:
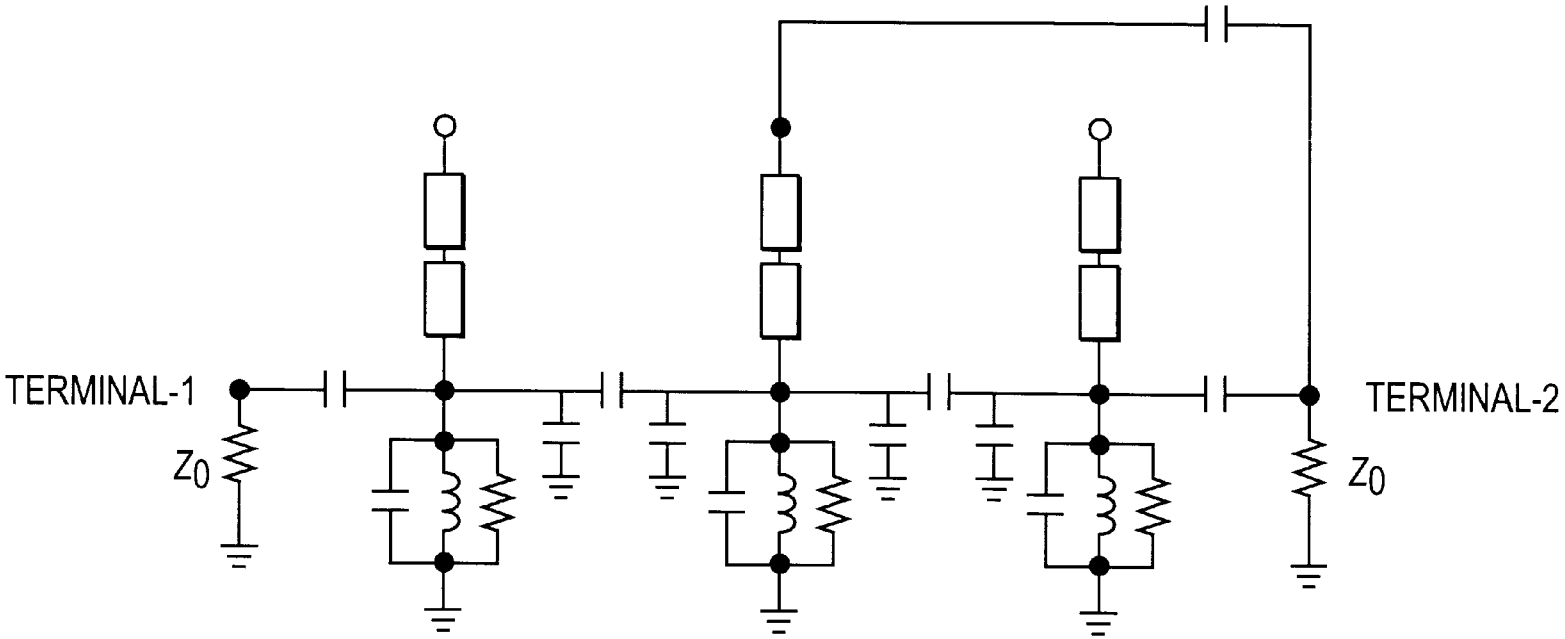
FIG. 22 is an equivalent circuit diagram of a filter formed by three stages of multiple spiral resonators.

Using the above-described equivalent circuit of the resonator (FIG. 18B), that of the external coupling (FIGS. 19A and 19B), and that of the interstage coupling (FIG. 21B), an example of the equivalent circuit of a filter which reflects the discrimination between inner periphery and outer periphery external coupling, and the difference in the polarity between left-handed and right-handed multiple spiral lines, is shown in FIG. 22. In this example, the coupling between a terminal-1 and a first-stage resonator, and the coupling between a terminal-2 and a last-stage resonator are each performed by means of capacitive coupling at the outer peripheries of the multiple spiral resonators. The terminal-2 and the second-stage resonator are coupled by jump-coupling via a capacitance at the inner periphery thereof. It should be noted that since two ideal 90° lines which are coupled in series with the resonators at the first and last stages, have no coupling at the inner periphery thereof, this equivalent circuit is provided with equivalent characteristics even if the two ideal 90° lines are eliminated.

Hereinafter, specific embodiments in accordance with the present invention will be described in detail.

First, the configuration of a filter in accordance with a first embodiment of the present invention will be described with reference to FIG. 5.

Figure 5:
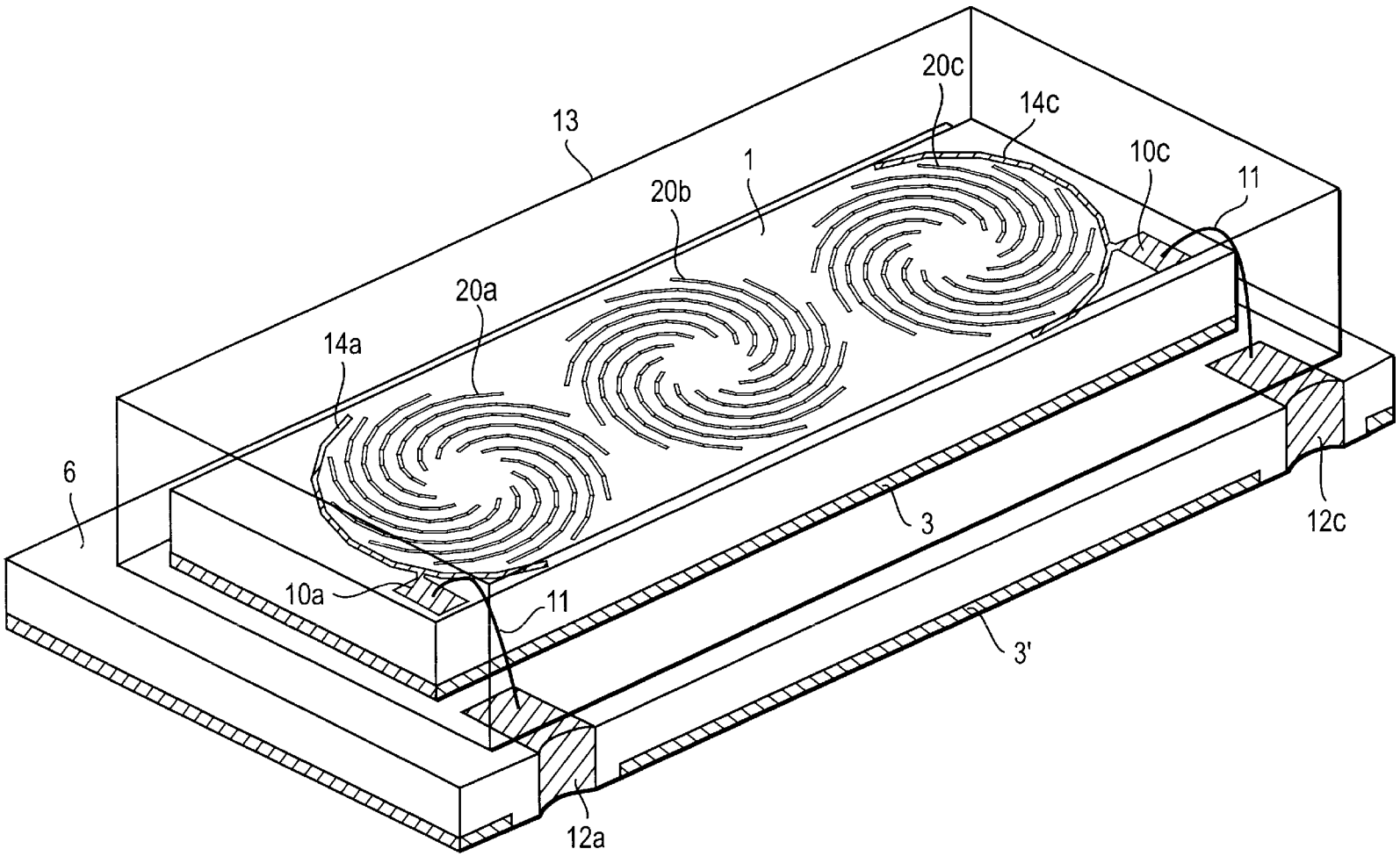
FIG. 5 is a perspective view showing the configuration of a filter in accordance with a first embodiment of the present invention.

FIG. 5 is a perspective view showing the filter in its entirety. Here, the figure is drawn by seeing through a cap 13. In FIG. 5, reference numeral 1 denotes a high-permittivity substrate formed of $LaNbO_3$, (Zr, Sn) $TiO_4$, barium titanate-based material, or the like. By arranging three multiple spiral lines on the top surface of this substrate, three multiple spiral resonators are formed. At the outer periphery portions of the dispositional area of the two outermost multiple spiral lines among these three multiple spiral lines, outer periphery coupling electrodes 14*a* and 14*c* which create an electrostatic capacitance between the outer peripheral edges and these electrodes are each formed. On the top surface of the dielectric substrate 1, bonding pads 10*a* and 10*c* are also formed. A ground electrode 3 is formed over substantially the entire bottom surface of this dielectric substrate 1. Reference numeral 6 denotes an insulating board formed of alumina, epoxy, or the like. Input/output terminals 12*a* and 12*c* each extend from the top surface of this insulating board 6 to its bottom surface via its end faces. A ground electrode 3' is also formed over substantially the entire bottom surface of the insulating board 6, except for the area where the input/output terminals 12*a* and 12*c* are formed.

The above-described dielectric substrate 1 is securely bonded to the top surface of the board 6 by a conductive paste, solder, or the like. The bonding pads 10*a* and 10*c* on the dielectric substrate 1 and the top surface of the input/output electrodes 12*a* and 12*c* provided on the board 6 are connected by bonding wires 11, respectively. The metallic cap 13 is bonded to the top surface of the board 6 by an insulating adhesive so as to cover the dielectric substrate 1 and the bonding wire portions. Thereby, the entire filter is shielded from electromagnetic fields.

The above-described multiple spiral lines 20*a*, 20*b*, and 20*c*, dielectric substrate 1, and ground electrode 3 constitute three multiple spiral resonators stages. In this example, the input/output terminal 12*a* is used as a signal input portion, and the input/output terminal 12*c* is used as a signal output portion. Each line in the multiple spiral line 20*a* of the first stage resonator, spirals right-handedly from the inner periphery to the outer periphery. Hereinafter, the resonator having this structure is referred to as a "right-handed resonator". In contrast, each line in the multiple spiral lines 20*b* and 20*c* of the second and third stage resonators, spirals left-handedly from the inner periphery to the outer periphery. Hereinafter, the resonator having this structure is referred to as a "left-handed resonator".

Figure 14A:
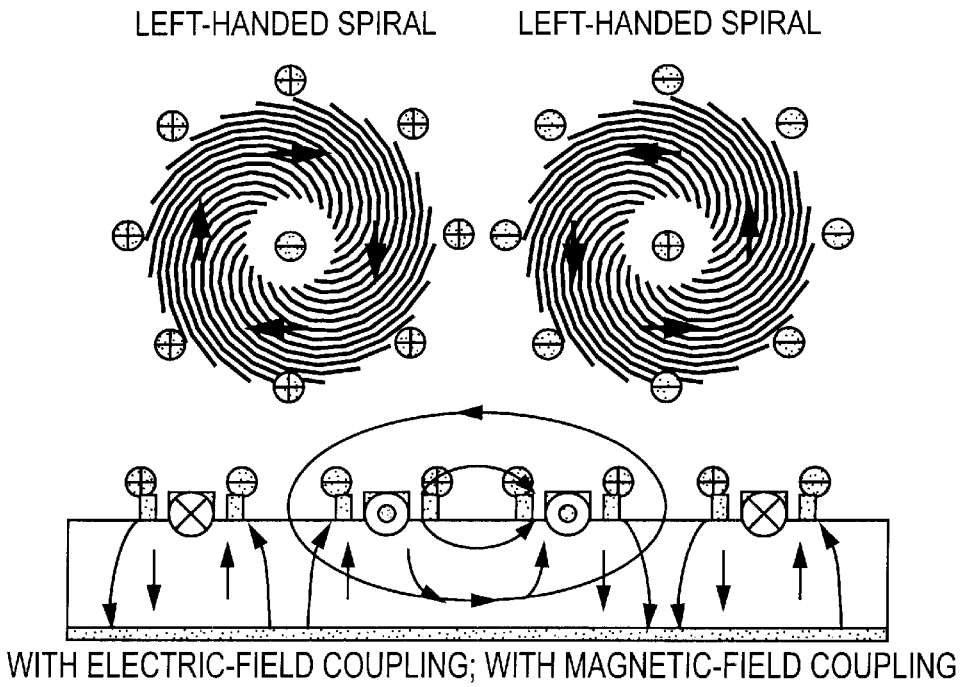
FIGS. 14A and 14B are views each illustrating a state of the coupling between two left-handed resonators.
Figure 14B:
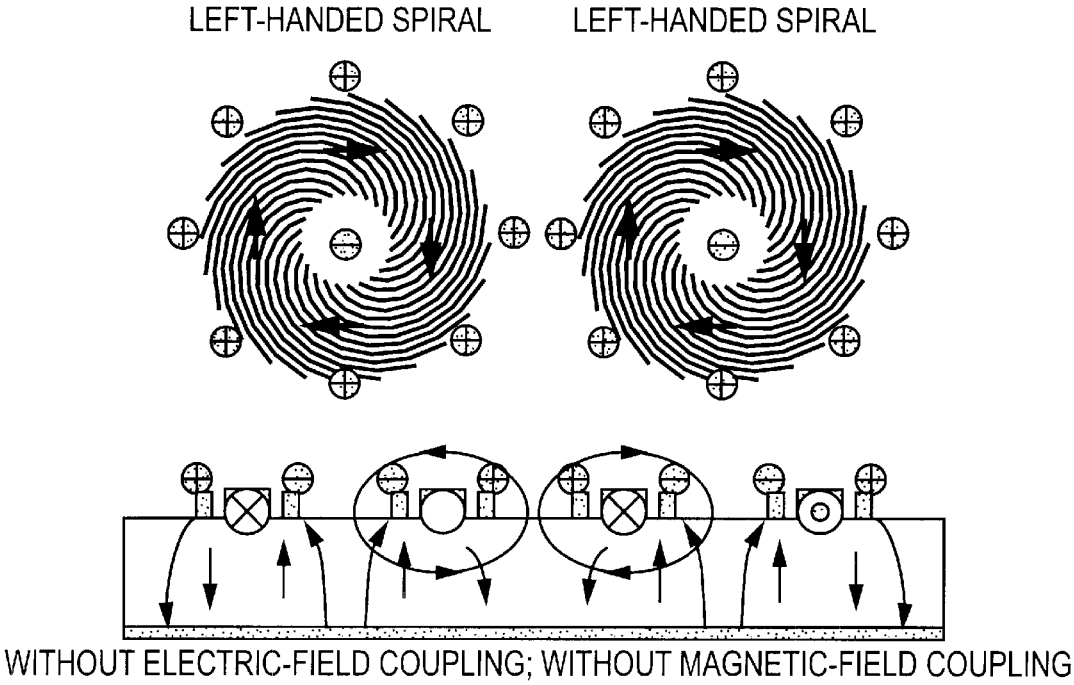

Here, the manner in which multiple spiral resonators are coupled, will be described with reference to FIGS. 14A–15B. FIGS. 14A and 14B show the manner in which two left-handed resonators are coupled, and FIGS. 15A and 15B show the manner in which a left-handed resonator and a right-handed resonator are coupled.

In the case where two left-handed resonators are coupled, when the directions of electromagnetic fields are as illustrated in FIG. 14A, the relationship between these resonators is a state "with electric-field coupling" and simultaneously "with magnetic-field coupling". On the other hand, when the directions of electromagnetic fields are as illustrated in FIG. 14B, the relationship between the resonators is a state "without electric-field coupling" and simultaneously "without magnetic-field coupling". That is, the electric-field coupling kc and the magnetic-field coupling kl cooperate, and thereby the coupling coefficient $k_{LL}$ between the two left-handed resonators becomes $k_{LL}>0$.

Figure 15A:
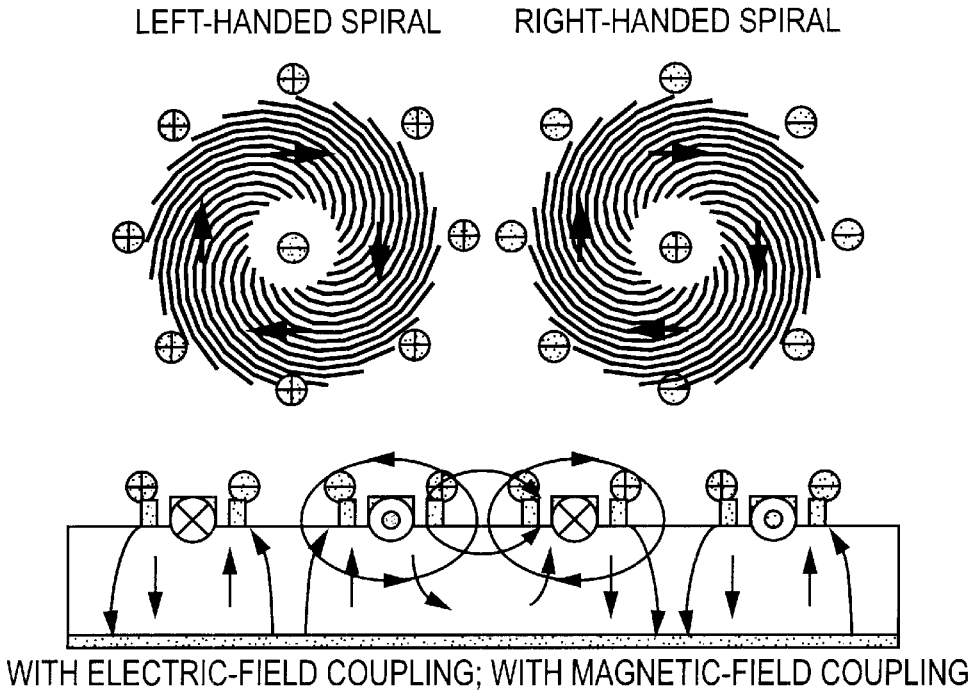
FIGS. 15A and 15B are views each illustrating a state of the coupling between a left-handed resonator and a right-handed resonator.
Figure 15B:
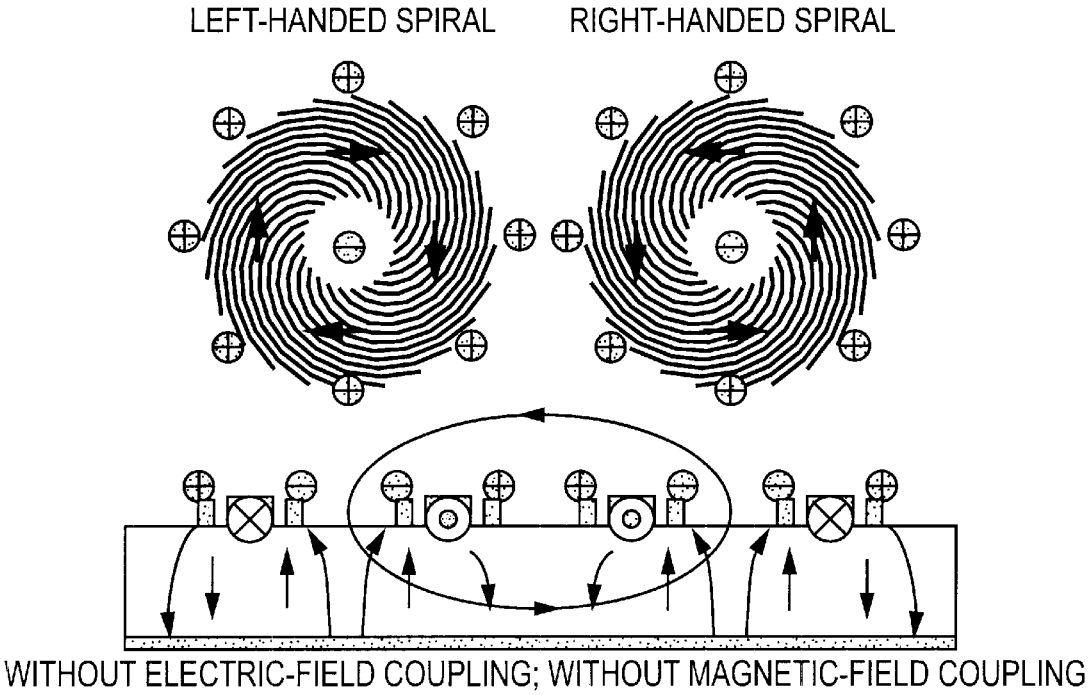

With regard to the coupling between a left-handed resonator and a right-handed resonator, when the directions of electromagnetic fields are as illustrated in FIG. 15A, the relationship between these resonators is a state "with electric-field coupling" and "without magnetic-field coupling". On the other hand, when the directions of electromagnetic fields are as illustrated in FIG. 15B, the relationship between the resonators is a state "without electric-field coupling" and "with magnetic-field coupling". That is, since the electric-field coupling and the magnetic-field coupling are cancelled by each other, and kc<kl, the coupling coefficient $k_{LR}$ between the left-handed resonator and the right-handed resonator becomes $k_{LR}<0$.

Thus, in accordance with the structure shown in FIG. 5, there exist (1) a coupling coefficient k12 between the first-stage and second-stage resonators, (2) a coupling coefficient k23 between the second-stage and third-stage resonators, and (3) a coupling coefficient k13 between the first-stage and third-stage resonators. Here, since each of (1) and (3) is a coupling between a left-handed resonator and a right-handed resonator, and (2) is a coupling between two left-handed resonators, the polarity of both k12 and k13 differs from that of k23, that is, the sign of both k12 and k13 is opposite to that of k23. This results in an attenuation pole which occurs on the higher frequency side of a pass band.

Next, with regard to the coupling between a left-handed resonator and a right-handed resonator, and that between two left-handed resonators, experimental results will be described with reference to FIGS. 16A to 16C.

Figure 16A:
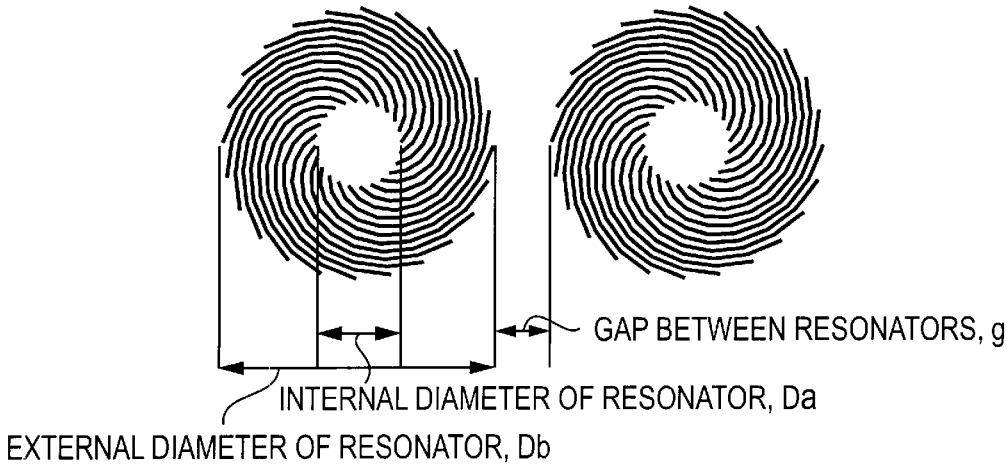
FIGS. 16A to 16C are views illustrating dispositional states of two adjacent resonators.
Figure 16B:
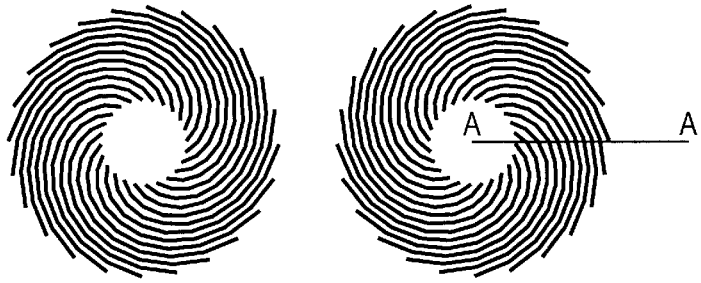
Figure 16C:
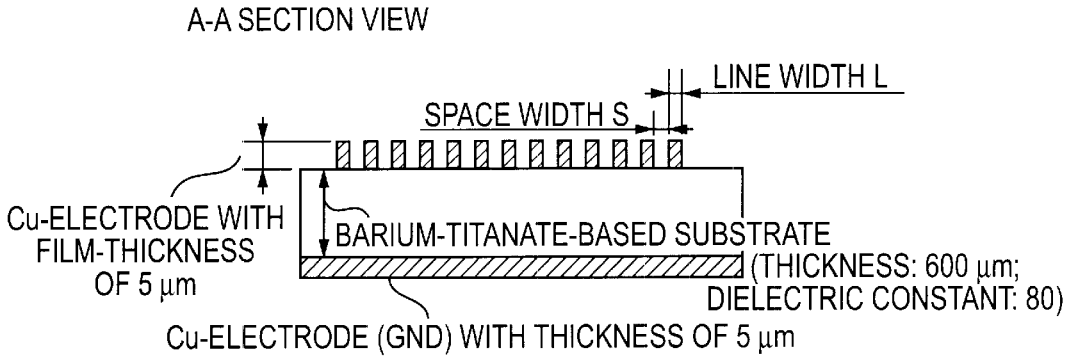

FIG. 16A shows the disposition of two left-handed resonators, and FIG. 16B shows the disposition of a left-handed resonator and a right-handed resonator. FIG. 16C is a sectional view of the resonator taken along a line 16C—16C in FIG. 16B. Here, the line width L of a spiral line was set to 1.3 μm, the space width S was 1.3 mm, and the number of lines n was 74. The number of circular rotations C made by the spiral line around the center point from the inner periphery to the outer periphery was 3.6 (although fewer rotations are shown in the drawing). The total line length Ltot from the inner periphery to the outer periphery was 9.1 μm, the internal diameter Da of the resonator was 116 mm, and the external diameter Db of the resonator was 1496 μm. The dielectric substrate used was a barium titanate-based substrate having a dielectric constant of 80, and the thickness thereof was set to 60 μm. Both the line and the ground electrodes are Cu-electrodes, and the thickness thereof was set to 5 μm. Table 2 below shows the coupling coefficients when the gap g between resonators was varied under the above-described conditions, with regard to FIGS. 16A and 16B.

TABLE 2

| GAP, g (μm) | COMBINATION | COUPLING COEFFICIENT (%) | ELECTRIC FIELD COUPLING COEFFICIENT (%) | MAGNETIC FIELD COUPLING COEFFICIENT (%) |
|---|---|---|---|---|
| 27 | LEFT-HANDED - LEFT-HANDED | 6.24 | 1.44 | 4.81 |
| 27 | LEFT-HANDED - RIGHT-HANDED | −3.37 | | |
| 35 | LEFT-HANDED - LEFT-HANDED | 5.79 | 1.34 | 4.45 |
| 35 | LEFT-HANDED - RIGHT-HANDED | −3.11 | | |

As shown in Table 2, when the gap g between resonators was 27 μm, the coupling coefficient $k_{LL}$ between two left-handed resonators became 6.24%, and the coupling coefficient $k_{LR}$ between a left-handed resonator and a right-handed resonator became −3.37%. Here, the electrical coupling coefficient kc is given by $kc=(k_{LL}+k_{LR})/2$, and the value thereof becomes 1.44%. On the other hand, the magnetic coupling coefficient k1 is given by $k1=(k_{LL}-k_{LR})/2$, and the value thereof becomes 4.81%. As the gap g between resonators is widened, the coupling coefficient between two left-handed resonators, and the coupling coefficient between a left-handed resonator and a right-handed resonator together decrease in value, but they still differ in polarity from each other.

In the example shown in FIG. 5, the first-stage resonator is right-handed one, and the second-stage and third-stage resonators are left-handed. More generally, by selecting the spiral direction of the spiral lines of each of the resonators, an attenuation pole can be arbitrarily formed on the higher frequency side or the lower frequency side of a pass band. Table 3 below shows the relationship between the spiral direction of spiral lines of a resonator and the position of an attenuation pole when using a band-pass filter formed of three resonator stages.

TABLE 3

| FIRST STAGE | SECOND STAGE | THIRD STAGE | POSITION OF ATTENUATION POLE |
|---|---|---|---|
| LEFT-HANDED | LEFT-HANDED | LEFT-HANDED | LOWER FREQUENCY SIDE |
| RIGHT-HANDED | LEFT-HANDED | LEFT-HANDED | HIGHER FREQUENCY SIDE |
| LEFT-HANDED | RIGHT-HANDED | LEFT-HANDED | LOWER FREQUENCY SIDE |
| LEFT-HANDED | LEFT-HANDED | RIGHT-HANDED | HIGHER FREQUENCY SIDE |
| RIGHT-HANDED | RIGHT-HANDED | LEFT-HANDED | HIGHER FREQUENCY SIDE |
| RIGHT-HANDED | LEFT-HANDED | RIGHT-HANDED | LOWER FREQUENCY SIDE |
| LEFT-HANDED | RIGHT-HANDED | RIGHT-HANDED | HIGHER FREQUENCY SIDE |
| RIGHT-HANDED | RIGHT-HANDED | RIGHT-HANDED | LOWER FREQUENCY SIDE |

Although the band-pass filter formed of three resonator stages has been taken here as an example, the present invention may be applied to a multi-stage filter having more than three stages. Even when forming a filter with more than three stages, an attenuation pole can be formed on the higher frequency side or on the lower frequency side of a pass band, or further on both of the lower and higher frequency sides, by combining three resonators.

In FIG. 5, the electrodes on the dielectric substrate 1 and those on the board 6 are connected by bonding wires. However, the connection may comprise bumps formed on the bottom surface of the dielectric substrate 1 or the top surface of the board 6, whereby the dielectric substrate 1 may be mounted on the board 6 by the flip-chip method.

Figure 6:
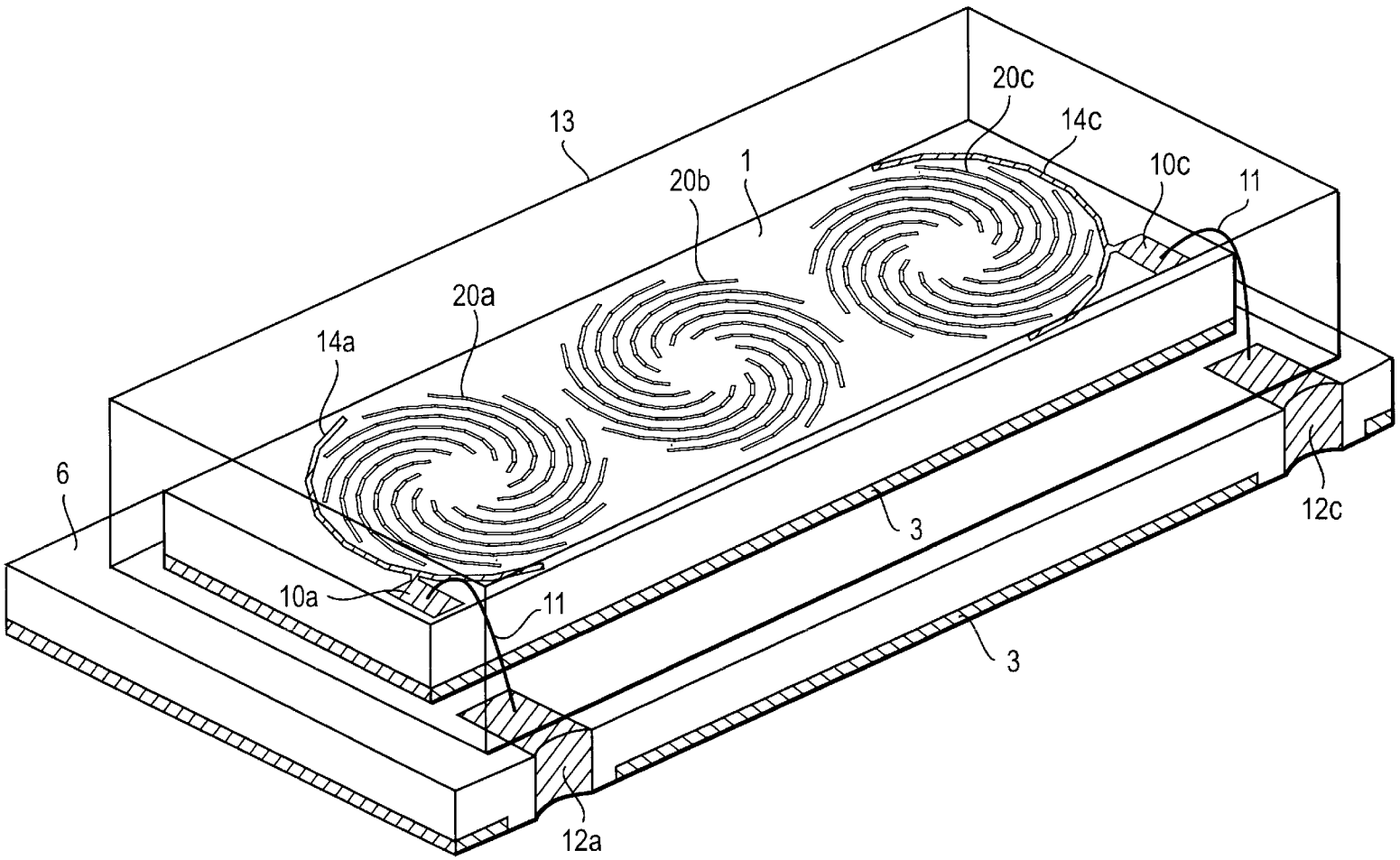
FIG. 6 is a perspective view showing the configuration of a filter in accordance with a second embodiment of the present invention.

FIG. 6 is a perspective view showing a filter in accordance with a second embodiment of the present invention. In this example, unlike the filter shown in FIG. 5, the first-stage resonator formed of the multiple spiral line 20*a* and the third-stage resonator formed of the multiple spiral line 20*c* are each set to be left-handed resonators, and the second-stage resonator formed of the multiple spiral line 20*b* is set to be a right-handed resonator. As shown in FIG. 15 and others, since the coupling between a left-handed resonator and a right-handed resonator is weaker than that between two left-handed resonators, the coupling between the adjacent resonators in the three stages shown in FIG. 6 is weak, which provides passing characteristics in a narrow bandwidth. In this connection, if all of the three resonators are set to be left-handed resonators, the spacings among these resonators must be increased in order to obtain a narrow pass band, which would result in an overall increase in the size of the filter. However, the structure shown in FIG. 6 allows the narrowing of bandwidth to be achieved without overall upsizing of the filter.

In the example shown in FIG. 6, the three resonators are arranged in the order of a left-handed resonator→a right-handed resonator→a left-handed resonator. However, these resonators may instead be arranged in the order of a right-handed resonator→a left-handed resonator→a right-handed resonator. The same passing characteristics in a narrow bandwidth can be thereby obtained.

Figure 7:
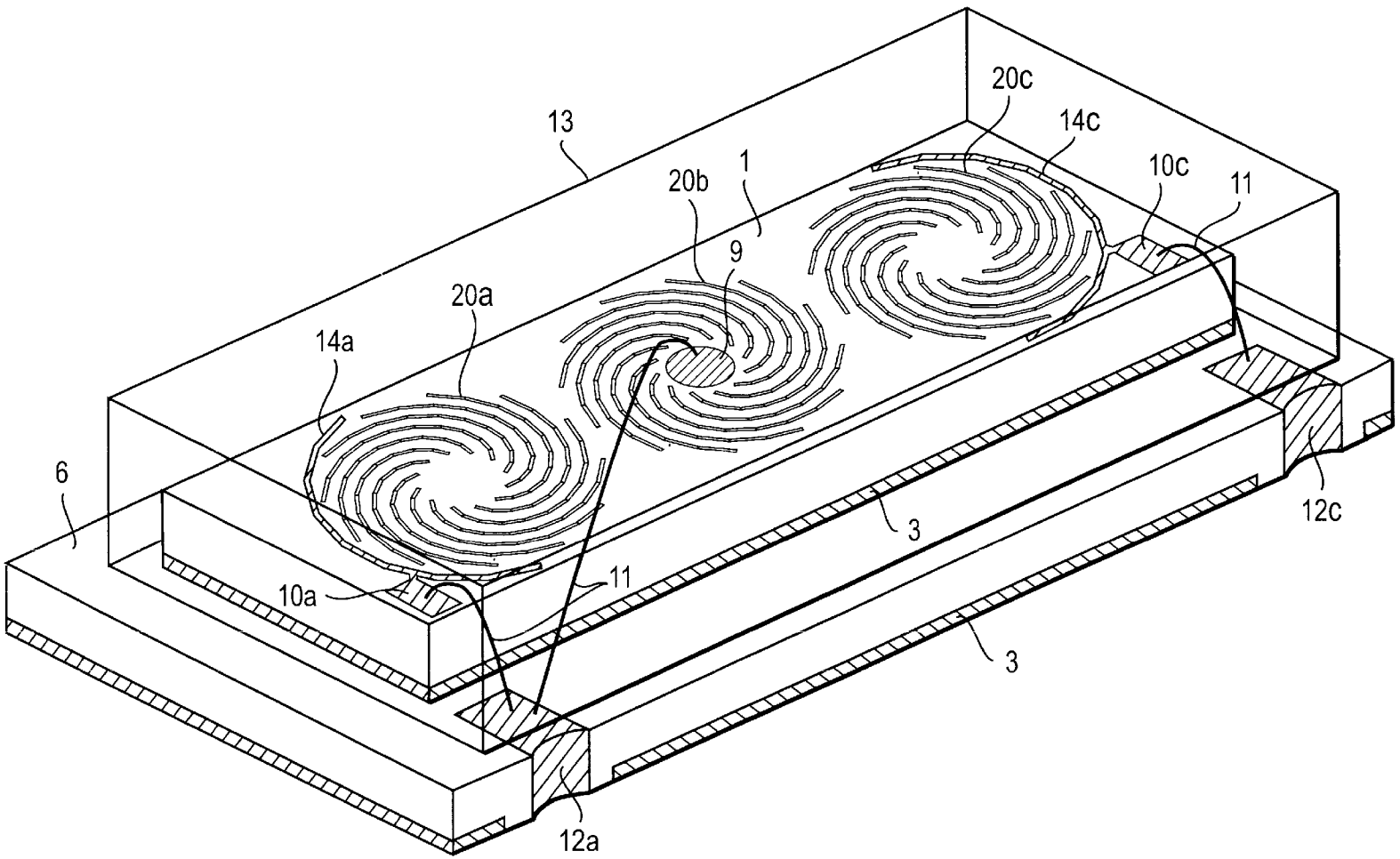
FIG. 7 is a perspective view showing the configuration of a filter in accordance with a third embodiment of the present invention.

FIG. 7 is a perspective view showing a filter in accordance with a third embodiment of the present invention. In this example, all of the three resonators are set to be left-handed resonators, and a coupling pad 9 for creating an electrostatic capacitance between the inner peripheral edge of the spiral lines and this pad, is formed at the center portion of the multiple spiral line of the second-stage resonator. This coupling pad 9 is connected to the input/output terminal 12*a* by a bonding wire 11. Other constructions are the same as those of the first and second embodiments.

In the filter shown in FIG. 7, the coupling (k01) between the input/output terminal 12*a* used as a signal input portion and the first-stage resonator, and the coupling (k34) between the input/output terminal 12*c* used as a signal output portion and the third-stage resonator are each performed at the outer peripheral portions of the multiple spiral lines 20*a* and 20*c*. On the other hand, the coupling (k02) between the input/output terminal 12*a* and the second-stage resonator is performed at the inner peripheral portions of the multiple spiral lines 20*b*. Each of the spiral lines which constitute a multiple spiral line has a length of about one half of a resonance wavelength, and the phases thereof are different by 180° between the inner periphery portion and the outer periphery portion. Consequently, the coupling coefficients k01 and k34 based on coupling at the outer periphery portions, and the coupling coefficient k02 based on a coupling at the inner periphery portion differ in polarity from each other, that is, the sign of both k01 and k34 becomes opposite to the sign of k02. This results in an attenuation pole at the higher frequency side of a pass band. The position of the attenuation pole can be controlled by varying the diameter of the coupling pad 9 provided at the inner periphery of the second-stage resonator and the gap between this coupling pad 9 and the inner peripheral edge of the multiple spiral line 20*b*. Specifically, by enlarging the diameter of the coupling pad 9 and thereby increasing the electrostatic capacitance between the multiple spiral line 20*b* and the coupling pad 9, k02 can be increased, so that the attenuation pole situated on the high frequency side moves toward the lower frequency side, thereby getting closer to a pass band.

The example shown in FIG. 7 is only one example of the general method by which an attenuation pole can be created at an arbitrary position on the lower frequency side or the higher frequency side of a pass band, depending upon whether the input/outputs and the resonator are coupled at the inner periphery or at the outer periphery. Table 4 below shows the relationship between the combinations of the coupling positions between the input/outputs and the resonators, and the positions of the attenuation poles created thereby, with regard to the three stages.

TABLE 4

| COUPLING POSITION BETWEEN INPUT AND FIRST-STAGE RESONATOR | COUPLING POSITION BETWEEN OUTPUT THIRD-STAGE RESONATOR | COUPLING POSITION BETWEEN INPUT AND SECOND-STAGE RESONATOR | POSITON OF ATTENUATION POLE |
|---|---|---|---|
| OUTER PERIPHERY | OUTER PERIPHERY | OUTER PERIPHERY | LOWER FREQUENCY SIDE |
| OUTER PERIPHERY | OUTER PERIPHERY | INNER PERIPHERY | HIGHER FREQUENCY SIDE |
| OUTER PERIPHERY | INNER PERIPHERY | OUTER PERIPHERY | LOWER FREQUENCY SIDE |
| INNER PERIPHERY | OUTER PERIPHERY | OUTER PERIPHERY | HIGHER FREQUENCY SIDE |
| INNER PERIPHERY | INNER PERIPHERY | OUTER PERIPHERY | HIGHER FREQUENCY SIDE |
| INNER PERIPHERY | OUTER PERIPHERY | INNER PERIPHERY | LOWER FREQUENCY SIDE |
| OUTER | INNER | INNER | HIGHER |

TABLE 4-continued

| COUPLING POSITION BETWEEN INPUT AND FIRST-STAGE RESONATOR | COUPLING POSITION BETWEEN OUTPUT THIRD-STAGE RESONATOR | COUPLING POSITION BETWEEN INPUT AND SECOND-STAGE RESONATOR | POSITON OF ATTENUATION POLE |
|---|---|---|---|
| PERIPHERY | PERIPHERY | PERIPHERY | FREQUENCY SIDE |
| INNER PERIPHERY | INNER PERIPHERY | INNER PERIPHERY | LOWER FREQUENCY SIDE |

In this manner, when the coupling position between the input terminal and the first-stage resonator and that between the input terminal and the second-stage resonator are identically inner peripheries, or identically outer peripheries, the attenuation pole occurs on the lower frequency side of a pass band. On the other hand, when the above-described two coupling positions differ from each other, the attenuation pole occurs on the higher frequency side of a pass band.

In this embodiment, a three-stage band-pass filter has been taken as an example, but the present invention may be applied to a filter provided with more than three resonators.

Next, a filter in accordance with a fourth embodiment of the present invention will be described in reference to FIGS. 8 and 9.

Figure 8:
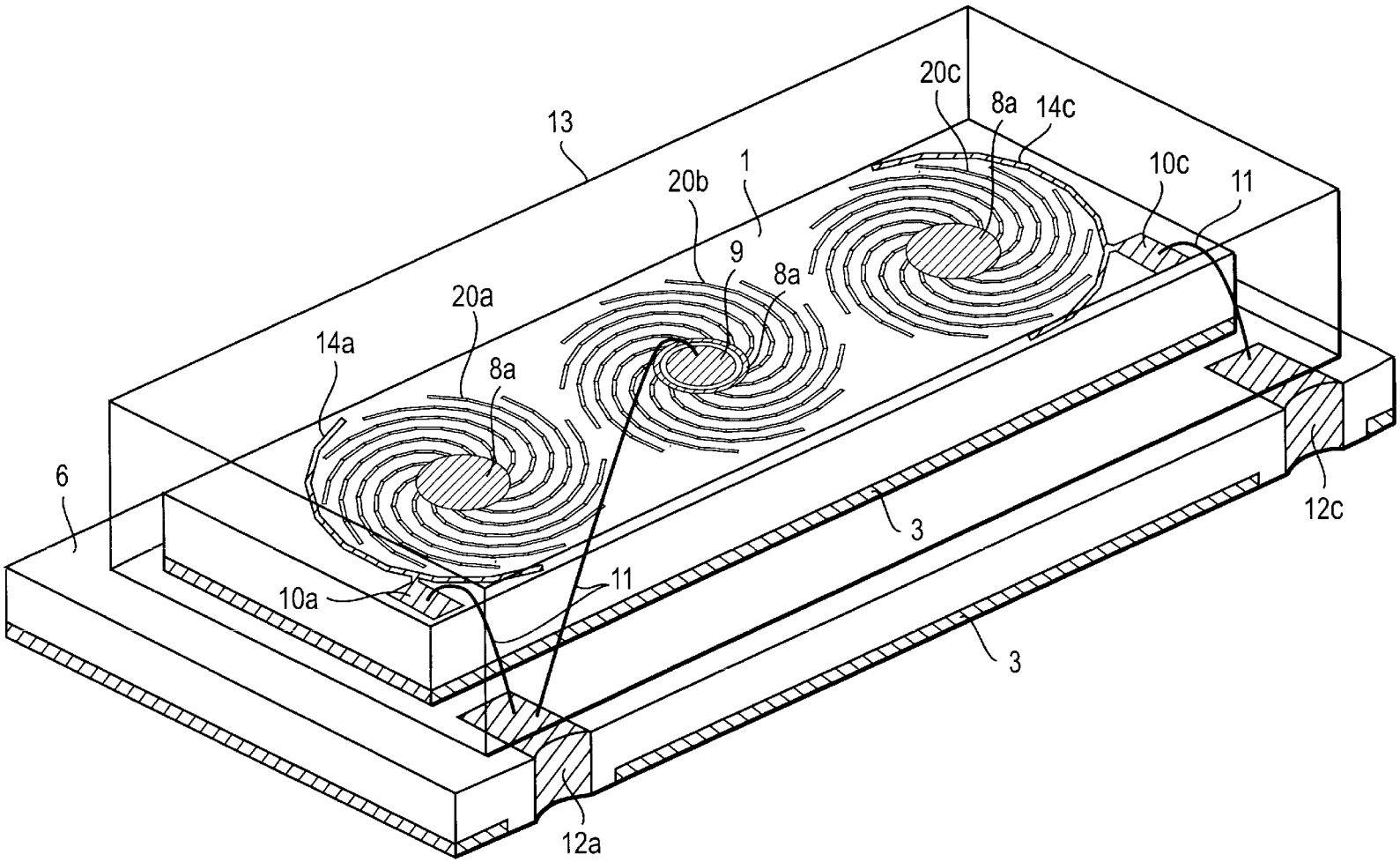
FIG. 8 is a perspective view showing the configuration of a filter in accordance with a fourth embodiment of the present invention.

FIG. 8 is a perspective view of this filter. Unlike the example shown in FIG. 7, a ring-shaped connection electrode 8b is connected to the inner peripheral edge of the multiple spiral line of the second-stage resonator. Inside this connection electrode 8*b*, there is further formed a coupling pad 9 for creating an electrostatic capacitance between the connection electrode 8*b* and this coupling pad 9. Also, circular connection electrodes 8*a* and 8*c* are connected to the inner peripheral edges of the multiple spiral lines of the first-stage and third-stage resonators.

Figure 9:
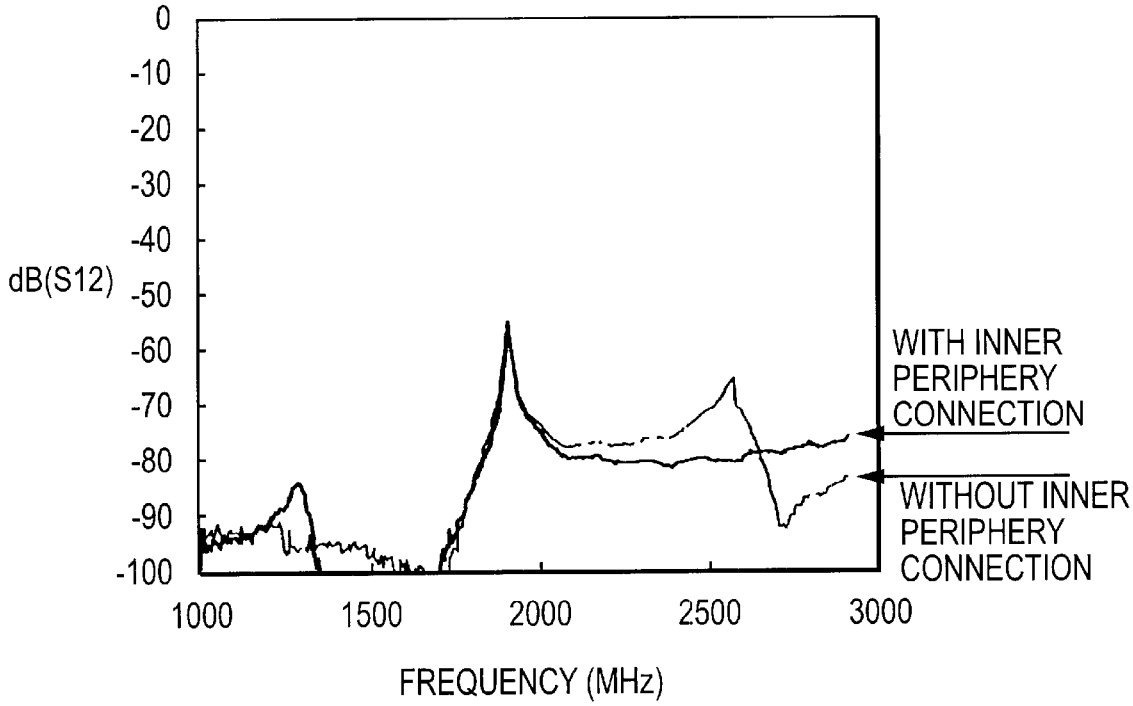
FIG. 9 is a diagram showing the spurious response characteristics of the resonators in the filter in accordance with the fourth embodiment and in a comparative filter.

FIG. 9 shows a comparison of the spurious response characteristics of the resonator, when the inner peripheral edges of the multiple spiral resonators are connected by the connection electrodes 8*a*, 8*b* and 8*c*, and when they are not connected. As can be seen from this figure, when the inner peripheral edges of the multiple spiral resonators are not connected, a spurious response is found in the vicinity of 2600 MHz. On the other hand, when the inner peripheral edges of the multiple spiral resonators are connected, the spurious response is suppressed, thereby allowing a significant attenuation in the higher frequency side of the pass band (vicinity of 1850 MHz) to be achieved.

In the example shown in FIG. 8, the inner peripheral edges of the multiple spiral resonators are connected, with respect to all three resonators. However, the inner peripheral edges of only one or more of the multiple spiral resonators has to be connected, with respect to a plurality of resonators constituting a filter. Similar effects can thereby be obtained.

Next, the configuration of a duplexer in accordance with a fifth embodiment of the present invention will be described in reference to FIG. 10 as a perspective view.

Figure 10:
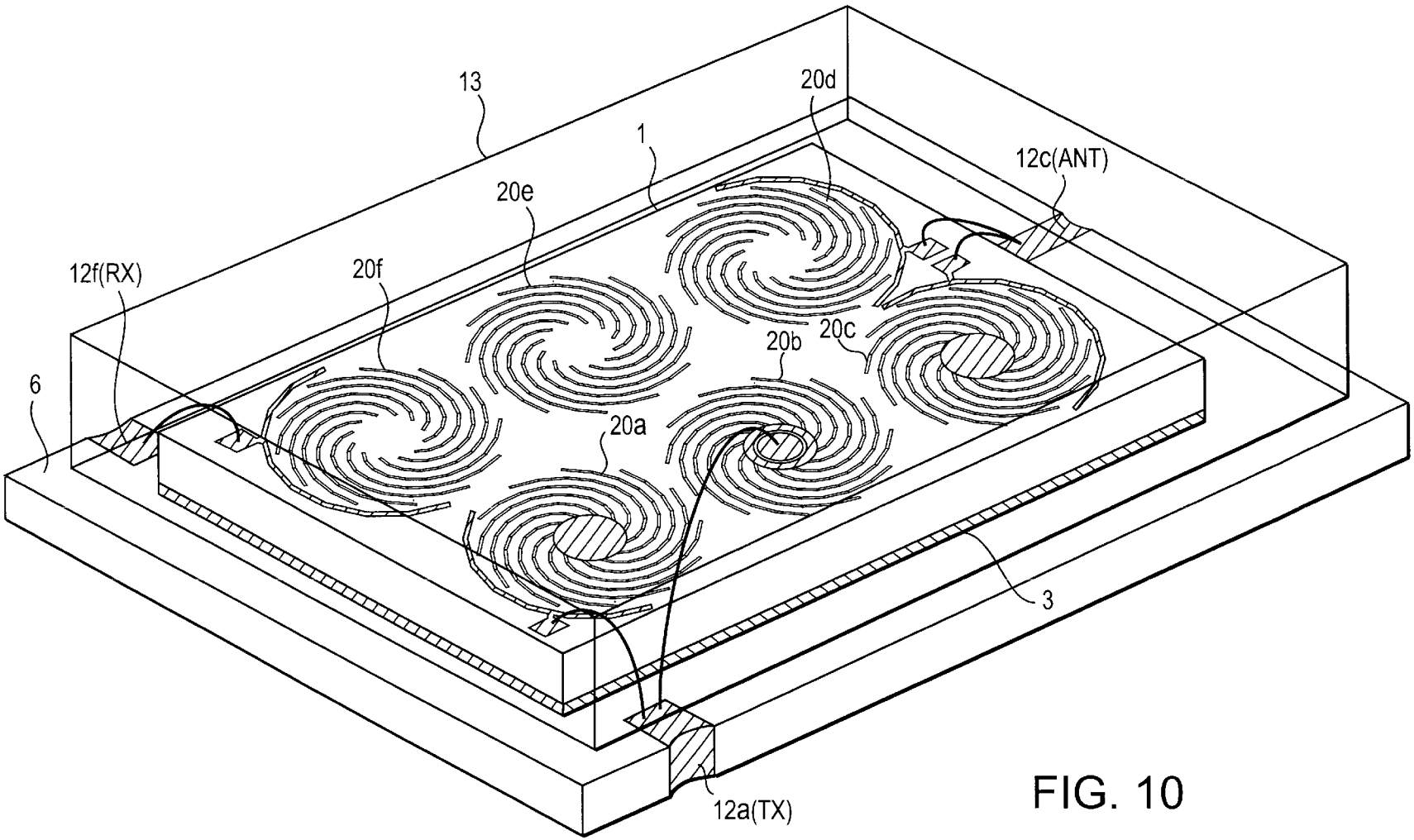
FIG. 10 is a perspective view illustrating the configuration of a duplexer in accordance with a fifth embodiment of the present invention.

As shown in FIG. 10, six multiple spiral resonators are constructed by forming six multiple spiral lines 20*a*, 20*b*, 20*c*, 20*d*, 20*e* and 20*f* on the top surface of a dielectric substrate 1, and forming a ground electrode 3 on the bottom surface thereof. Among the six multiple spiral resonators, three resonators formed of multiple spiral lines 20*a*, 20*b*, and 20*c* are used as a transmitting filter, and three resonators formed of the remaining multiple spiral lines 20*d*, 20*e*, and

20*f* are used as a receiving filter. The dielectric substrate 1 is mounted on a board 6 on which the input/output terminals 12*a,* 12*c,* and 12*f* are formed. Three outer periphery coupling electrodes and the input/output terminals 12*a,* 12*c* and 12*f* on the board 6 are connected, respectively, by wire-bonding, and a coupling pad and the input/output terminal 12*a* are also connected using bonding wire. Thereby, the input/output terminal 12*a* is used as a transmission signal input terminal TX, the input/output terminal 12*c* is used as an antenna terminal ANT, and the input/output terminal 12*f* is used as a reception signal output terminal RX.

The transmitting filter portion in FIG. 10 is fundamentally the same as the filter shown in FIG. 8. The transmitting filter portion, therefore, exhibits characteristics of having an attenuation pole in the higher frequency side of a pass band. The three resonators constituting the receiving filter portion in FIG. 10 are all set to be left-handed resonators, and have coupling positions with input/output terminals at outer periphery portions of the first-stage and third-stage resonators, respectively. Hence, the coupling coefficient k13 between the first-stage and third-stage resonators, the coupling coefficient k12 between the first-stage and second-stage resonators, and the coupling coefficient k23 between the second-stage and third-stage resonators are identical in the polarity with one another, thereby creating an attenuation pole at the lower frequency side of a pass band. Therefore, use of this duplexer in a communication system in which a transmitting band exists on the lower frequency side, and in which a receiving band exists on the higher frequency side, reliably prevents transmission signals from leaking into the reception portion, by virtue of the higher frequency side attenuation pole in the transmitting filter and the lower frequency side attenuation pole in the receiving filter.

Figure 11:
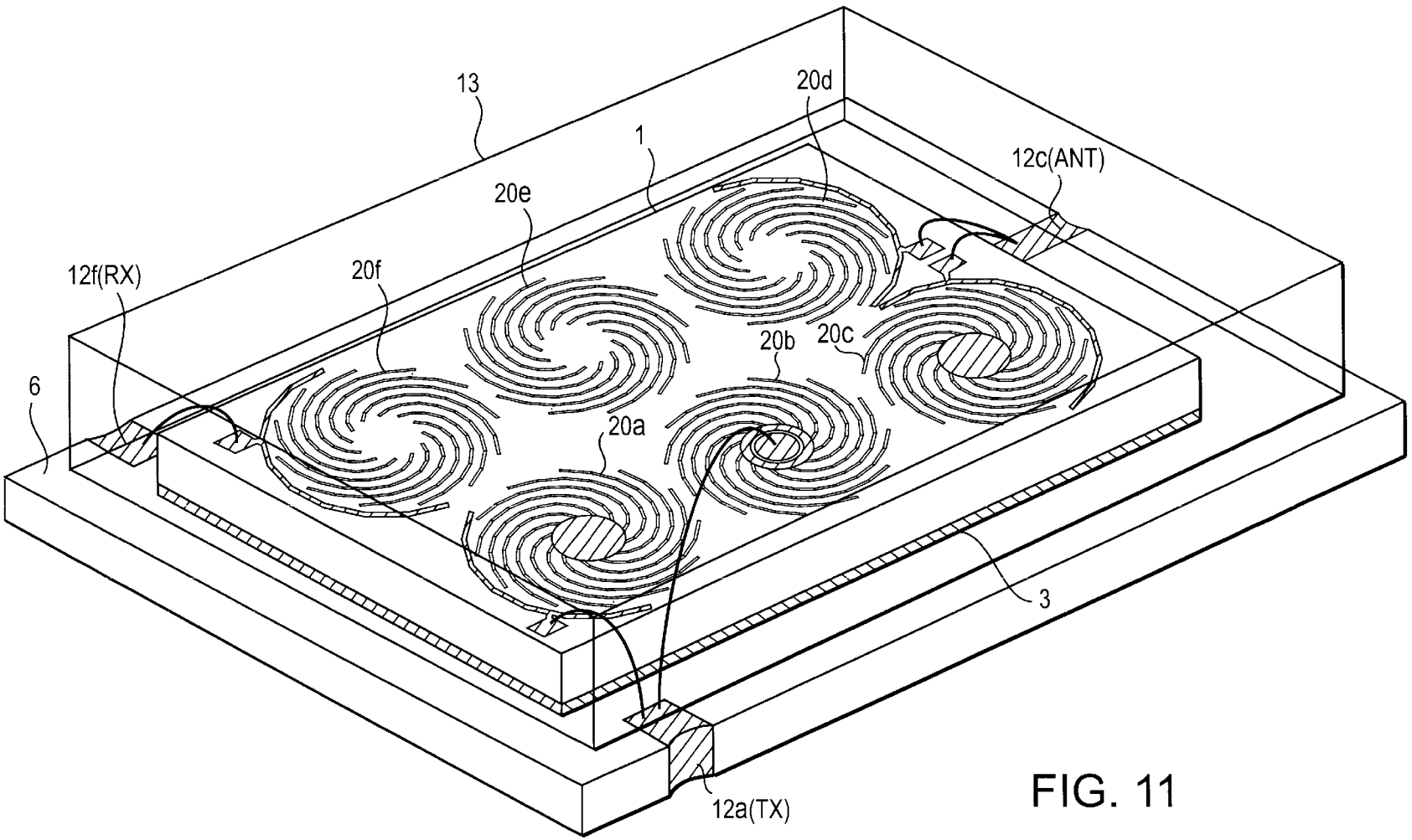
FIG. 11 is a perspective view illustrating the configuration of a duplexer in accordance with a sixth embodiment of the present invention.

FIG. 11 is a perspective view showing a duplexer in accordance with a sixth embodiment of the present invention. Unlike the duplexer shown in FIG. 10, in this case, the resonators constituting the receiving filter are set to be right-handed resonators. That is, the spiral direction of the multiple spiral line of each of the resonators constituting the receiving filter, is set to be opposite to that of the multiple spiral line of each of the resonators constituting the transmitting filter. As described above, since the coupling coefficient between a left-handed resonator and a right-handed resonator is smaller than that between two left-handed resonators or between two right-handed resonators, the structure shown in FIG. 11 allows the isolation between the transmitting filter and the receiving filter to be improved.

Figure 12:
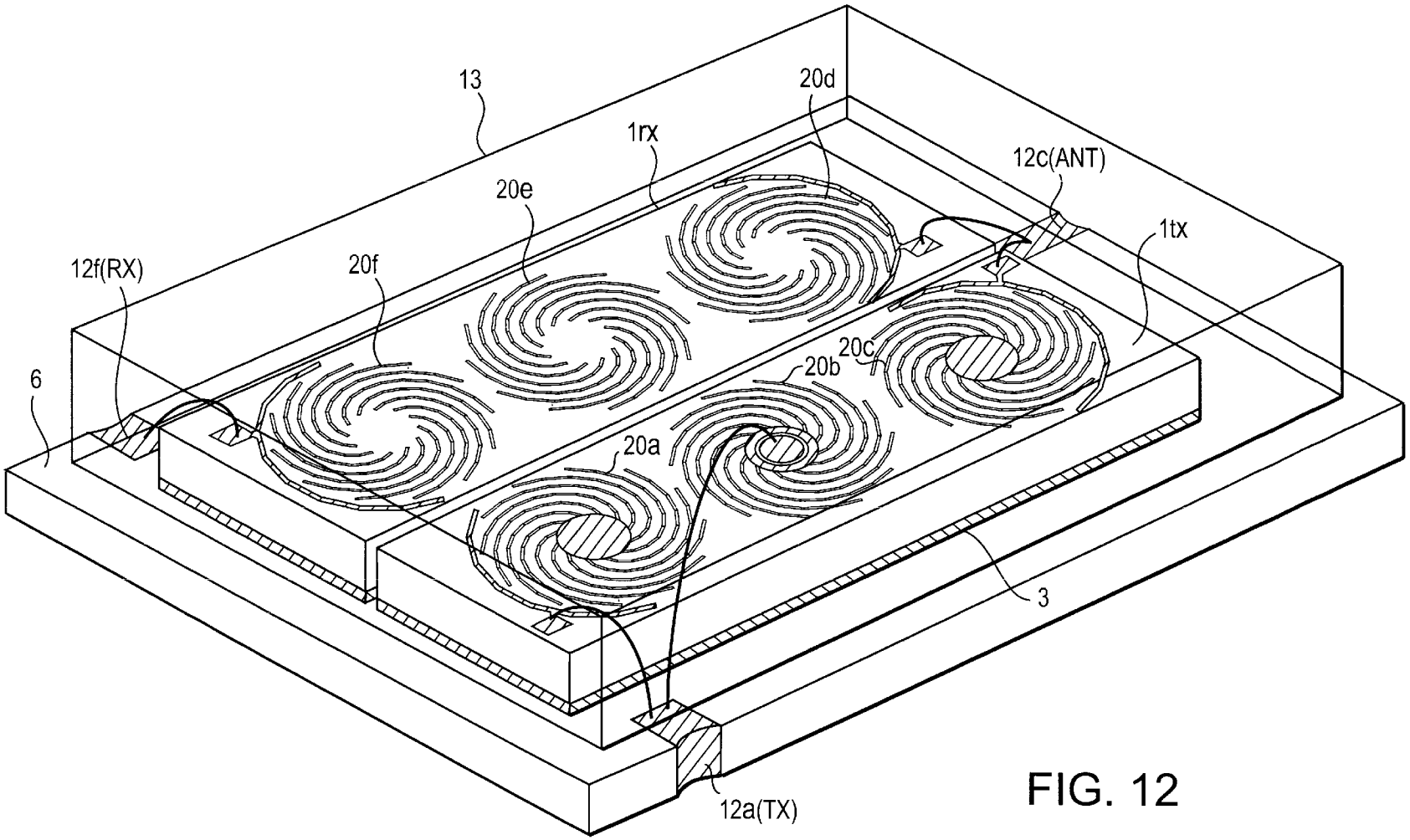
FIG. 12 is a perspective view illustrating the configuration of a duplexer in accordance with a seventh embodiment of the present invention.

FIG. 12 is a perspective view showing a duplexer in accordance with a seventh embodiment of the present invention. Unlike the duplexer shown in FIG. 11, this duplexer has two separated dielectric substrates, that is, a dielectric substrate 1*tx* for the portion constituting a transmitting filter, and a dielectric substrate 1*rx* for the portion constituting a receiving filter. This structure allows an electric field in the dielectric substrates to be cut off by an air layer between the dielectric substrates, and thereby enables the isolation between the transmitting filter and the receiving filter to be improved.

In addition, by inserting a metallic wall between the dielectric substrate 1*tx* for the transmitting filter, and the dielectric substrate 1*rx* for the receiving filter, the isolation can be even more enhanced.

Figure 13:
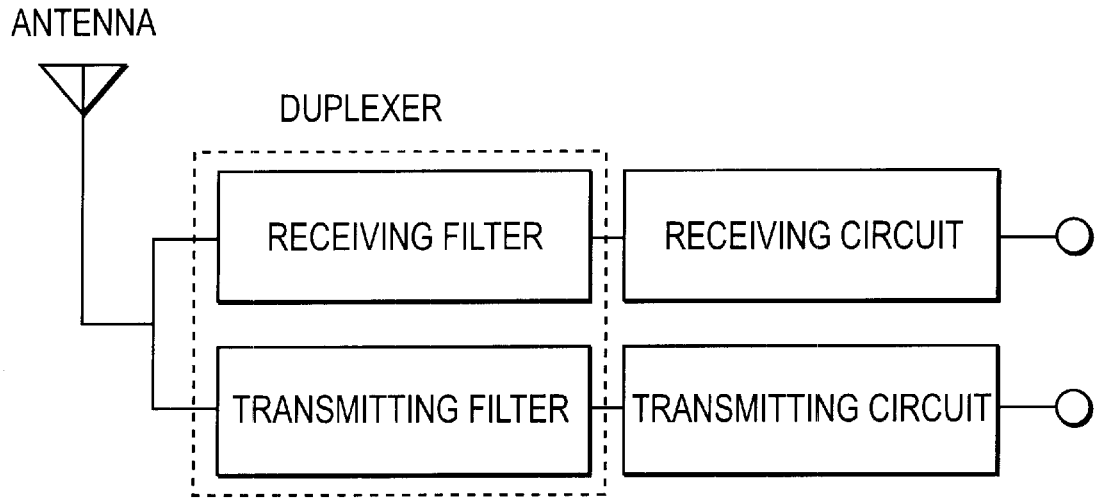
FIG. 13 is a block diagram illustrating the configuration of a communication device in accordance with an eighth embodiment of the present invention.

FIG. 13 is a block diagram showing the configuration of a communication device in accordance with an eighth embodiment of the present invention. Herein, a duplexer having a feature as shown in any of FIGS. 10 to 12, for example, is used as a duplexer, or a filter having a feature as shown in any one of the first to fourth embodiments, for example, is used as a receiving filter or transmitting filter each comprised in a duplexer. The duplexer is mounted on a circuit board in a manner such that a transmitting circuit and a receiving circuit are formed on the circuit board, the transmitting circuit is connected to a transmission signal input terminal of a duplexer, the receiving circuit is connected to a reception signal output terminal, and an antenna is connect to an antenna terminal.

As described in the foregoing, in accordance with the present invention, the current concentration at the edge portions of a multiple spiral line is reduced very efficiently, and thereby the overall power loss is suppressed, which allows a filter or a duplexer having a low insertion loss to be achieved. In addition, an attenuation pole can be arbitrarily formed on the higher frequency side or the lower frequency side of a pass band when using this filter as a band pass filter.

Furthermore, in accordance with the present invention, there is provided a duplexer formed by combining a filter in which an attenuation pole occurs on the lower frequency side of a pass band, and one in which an attenuation pole occurs on the higher frequency side of the pass band, whereby leakage of transmission signals into the receiving circuit can be prevented with a reliability.

Moreover, in accordance with the present invention, there is provided a communication device which allows an overall size-reduction to be achieved, which reduces the insertion loss at the high-frequency transmission/reception portion, which prevents mutual interference in adjacent bands, and which improves communication qualities such as noise characteristics and transmission speed.

While the present invention has been described with reference to what are at present considered to be the preferred embodiments, it is to be understood that various changes and modifications may be made thereto without departing from the invention in its broader aspects and therefore, it is intended that the appended claims cover all such changes and modifications as fall within the true spirit and scope of the invention.

What is claimed is:

1. A filter, comprising:

at least three resonators arranged on a substrate, each of which resonators is an aggregate of a plurality of lines each having a spiral shape, and arranged around a predetermined point of said substrate;

in each of said resonators, both ends of at least a portion of said plurality of lines being arranged substantially at inner and outer periphery portions of said aggregate, respectively, and said plurality of lines being disposed so as not to intersect each other; and the spiral direction of said spiral lines in at least one resonator being opposite to that of said spiral lines in the other resonators.

2. A filter, comprising:

at least three resonators arranged on a substrate, each of which resonators is an aggregate of a plurality of lines each having a spiral shape, and arranged around a predetermined point of said substrate;

in each of which resonators, both ends of at least a portion of said plurality of lines being arranged substantially at inner and outer periphery portions of said aggregate, respectively, and said plurality of lines being disposed so as not to intersect each other;

input and output portions for said filter;

a coupling electrode provided at said inner periphery portion of said plurality of lines in at least one resonator, and said inner periphery portion and one of said input and output portions being coupled to each other by said coupling electrode.

3. A duplexer comprising:

a transmitting filter and a receiving filter;

at least one of said transmitting filter and said receiving filter being a filter in accordance with claim 1 or claim 2; and an output portion of said transmitting filter and an input portion of said receiving filter being connected in common to an antenna terminal.

4. A communication device including a high-frequency circuit, and connected thereto a duplexer in accordance with claim 3.

5. A duplexer comprising:

a transmitting filter and a receiving filter;

each of said transmitting filter and said receiving filter being a filter in accordance with claim 1 or claim 2; and an output portion of said transmitting filter and an input portion of said receiving filter being connected in common to an antenna terminal.

6. A communication device including a high-frequency circuit, and connected thereto a duplexer in accordance with claim 5.

7. A communication device including a high-frequency circuit, and connected thereto a filter in accordance with claim 1 or claim 2.

8. A duplexer, comprising:

a transmitting filter and a receiving filter, each comprising a plurality of resonators arranged on a substrate, each of which resonators is an aggregate of a plurality of lines each having a spiral shape and arranged around a predetermined point of said substrate;

in each of which resonators, both ends of at least a portion of said plurality of lines being arranged substantially at inner and outer periphery portions of said aggregate, respectively, and said plurality of lines being disposed so as not to intersect each other; and the spiral direction of said spiral lines in the resonators constituting said transmitting filter and the spiral direction of said spiral lines in the resonators constituting said receiving filter being opposite to each other.

9. A communication device including a high-frequency circuit, and connected thereto a duplexer in accordance with claim 8.

10. A duplexer comprising:

a transmitting filter and a receiving filter, each filter having an input portion and an output portion;

an output portion of said transmitting filter and an input portion of said receiving filter being connected in common to an antenna terminal;

one of said transmitting and receiving filters comprising:

at least three resonators arranged on a substrate, each of which resonators is an aggregate of a plurality of lines each having a spiral shape, and arranged around a predetermined point of said substrate;

in each of which resonators, both ends of at least a portion of said plurality of lines being arranged substantially at inner and outer periphery portions of said aggregate, respectively, and said plurality of lines being disposed so as not to intersect each other;

a coupling electrode provided at said inner periphery portion of said plurality of lines in at least one resonator, and said inner periphery portion and one of said input and output portions being coupled to each other by said coupling electrode; and the other filter being a filter which is constructed by arranging, on said substrate, at least three resonators, each of which is an aggregate of a plurality of lines each having a spiral shape, in each of which both ends of at least a portion of said plurality of lines are each distributed on the substantial inner and outer periphery portions of said aggregate around a predetermined point of a substrate, and in each of which said plurality of lines are disposed so as not to intersect each other, wherein the respective spiral directions of said spiral lines in said at least three resonators are identical with one another.

11. A communication device including a high-frequency circuit, and connected thereto a duplexer in accordance with claim 10.

* * * * *